US010676220B2

(12) United States Patent
Vardakostas et al.

(10) Patent No.: US 10,676,220 B2
(45) **Date of Patent: *Jun. 9, 2020**

(54) BAGGING SYSTEM FOR PACKAGING A FOODSTUFF

(71) Applicant: Creator, Inc., San Francisco, CA (US)

(72) Inventors: Alexandros Vardakostas, San Francisco, CA (US); John Lawrence McDonald, Oakland, CA (US); Steven Frehn, San Francisco, CA (US)

(73) Assignee: Creator, Inc., San Francisco, CA (US)

( * ) Notice: Subject to any disclaimer, the term of this patent is extended or adjusted under 35 U.S.C. 154(b) by 270 days.

This patent is subject to a terminal disclaimer.

(21) Appl. No.: 15/664,502

(22) Filed: Jul. 31, 2017

(65) Prior Publication Data

US 2018/0022482 A1 Jan. 25, 2018

Related U.S. Application Data

(63) Continuation of application No. 14/493,185, filed on Sep. 22, 2014, now Pat. No. 9,718,568.

(Continued)

(51) Int. Cl.
*B65B 5/04* (2006.01)
*B65B 35/20* (2006.01)

(Continued)

(52) U.S. Cl.
CPC ..... *B65B 5/045* (2013.01); *B65B 35/205* (2013.01); *B65B 43/14* (2013.01); *B65B 43/34* (2013.01); *B65B 25/16* (2013.01)

(58) Field of Classification Search
CPC ..... B65B 5/045; B65B 25/16; B65B 35/205; B65B 35/24; B65B 43/14; B65B 43/26; B65B 43/34; B65B 43/44

(Continued)

(56) References Cited

U.S. PATENT DOCUMENTS 2,946,166 A 7/1960 Baxter
3,217,464 A * 11/1965 Feingold ..... B65B 35/405 53/259

(Continued)

FOREIGN PATENT DOCUMENTS

DE 1207261 B 12/1965
JP H06007127 A 1/1994

(Continued)

*Primary Examiner* — Stephen F. Gerrity

(74) *Attorney, Agent, or Firm* — Harness, Dickey & Pierce, P.L.C.

(57) ABSTRACT

A system includes a conveyor that transports a carriage carrying a foodstuff along a path. A bag dispenser contains multiple bags and moves a first bag into the path. A paddle includes a hinge at a trailing edge of the paddle. The paddle includes an actuator that moves a leading edge of the paddle relative to the trailing edge between retracted and extended positions. The leading edge of the paddle moves into a mouth of the first bag as the leading edge is moved from the retracted to the extended position. While the paddle is in the extended position, movement of the carriage and the foodstuff underneath the paddle rotates the leading edge of the paddle about the hinge to open the mouth of the first bag such that continued movement of the carriage and the foodstuff moves the foodstuff through the mouth and into the first bag.

20 Claims, 12 Drawing Sheets

Related U.S. Application Data

(60) Provisional application No. 61/880,360, filed on Sep. 20, 2013.

(51) Int. Cl.
*B65B 43/14* (2006.01)
*B65B 43/34* (2006.01)
*B65B 25/16* (2006.01)

(58) Field of Classification Search
USPC ..... 53/570, 571, 573, 258, 259, 384.1
See application file for complete search history.

(56) References Cited

U.S. PATENT DOCUMENTS

| | | | | |
|---|---|---|---|---|
| 3,412,522 | A | 11/1968 | Schorer | |
| 3,490,195 | A | 1/1970 | Abramson | |
| 3,527,337 | A | 9/1970 | Formo | |
| 3,590,553 | A | 7/1971 | Formo | |
| 3,783,580 | A | 1/1974 | Raudys | |
| 3,868,807 | A | 3/1975 | Noyes et al. | |
| 4,062,169 | A | 12/1977 | Lister et al. | |
| 4,147,012 | A | 4/1979 | van Mil | |
| 4,368,608 | A * | 1/1983 | Ray | B65B 43/36 53/385.1 |
| 4,669,251 | A * | 6/1987 | Inagaki | B65D 33/14 53/386.1 |
| 4,923,064 | A | 5/1990 | Hannon | |
| 5,056,300 | A | 10/1991 | Suzuki et al. | |
| 5,152,124 | A | 10/1992 | Ishii et al. | |
| 5,228,275 | A | 7/1993 | Formo | |
| 5,249,409 | A | 10/1993 | Jensen | |
| 5,365,835 | A | 11/1994 | Naramura | |
| 5,493,958 | A | 2/1996 | Naramura | |
| 5,502,956 | A | 4/1996 | Rompa | |
| 5,540,943 | A | 7/1996 | Naramura | |
| 5,546,848 | A | 8/1996 | Naramura | |
| 5,549,040 | A | 8/1996 | Naramura | |
| 5,562,183 | A | 10/1996 | Naramura | |
| 5,797,245 | A | 8/1998 | Murakami | |
| 5,946,888 | A | 9/1999 | Foster et al. | |
| 6,421,984 | B1 | 7/2002 | Murgatroyd et al. | |
| 6,755,008 | B2 * | 6/2004 | Schmetzer et al. | B65B 5/067 53/571 |
| 9,718,568 | B2 * | 8/2017 | Vardakostas et al. | B65B 5/045 |
| 2006/0059868 | A1 | 3/2006 | Melville | |
| 2007/0193229 | A1 | 8/2007 | Stackley et al. | |
| 2011/0072767 | A1 | 3/2011 | Suzuki et al. | |
| 2014/0245703 | A1 | 9/2014 | Suzuki et al. | |

FOREIGN PATENT DOCUMENTS

| | | | |
|---|---|---|---|
| JP | H07215471 | A | 8/1995 |
| JP | H07215472 | A | 8/1995 |
| JP | H07227195 | A | 8/1995 |
| JP | H07227196 | A | 8/1995 |
| JP | H07227197 | A | 8/1995 |
| JP | H07227198 | A | 8/1995 |
| JP | H07227199 | A | 8/1995 |
| JP | H07232807 | A | 9/1995 |
| JP | H07255604 | A | 10/1995 |
| JP | H07313373 | A | 12/1995 |
| JP | H0871003 | A | 3/1996 |
| JP | 3178899 | B2 | 6/2001 |

* cited by examiner

BAGGING SYSTEM FOR PACKAGING A FOODSTUFF

CROSS-REFERENCE TO RELATED APPLICATIONS

This application is a continuation of U.S. patent application Ser. No. 14/493,185 filed Sep. 22, 2014 (now U.S. Pat. No. 9,718,568), which claims the benefit of U.S. Provisional Patent Application No. 61/880,360 filed Sep. 20, 2013. The entire disclosures of the applications referenced above are incorporated by reference.

This application is related by subject matter to U.S. patent application Ser. No. 13/911,637 filed Jun. 6, 2013 (now. U.S. Pat. No. 9,386,799), and to U.S. patent application Ser. No. 14/208,149, filed on Mar. 13, 2014 (now pending). The entire disclosures of these applications are incorporated by reference.

FIELD

This invention relates generally to the field of food preparation, and more specifically to a new and useful system and method for bagging a food item.

DETAILED DESCRIPTION

The following description of the embodiment of the invention is not intended to limit the invention to these embodiments, but rather to enable any person skilled in the art to make and use this invention.

1. Bagging System and Method

Figure 1:
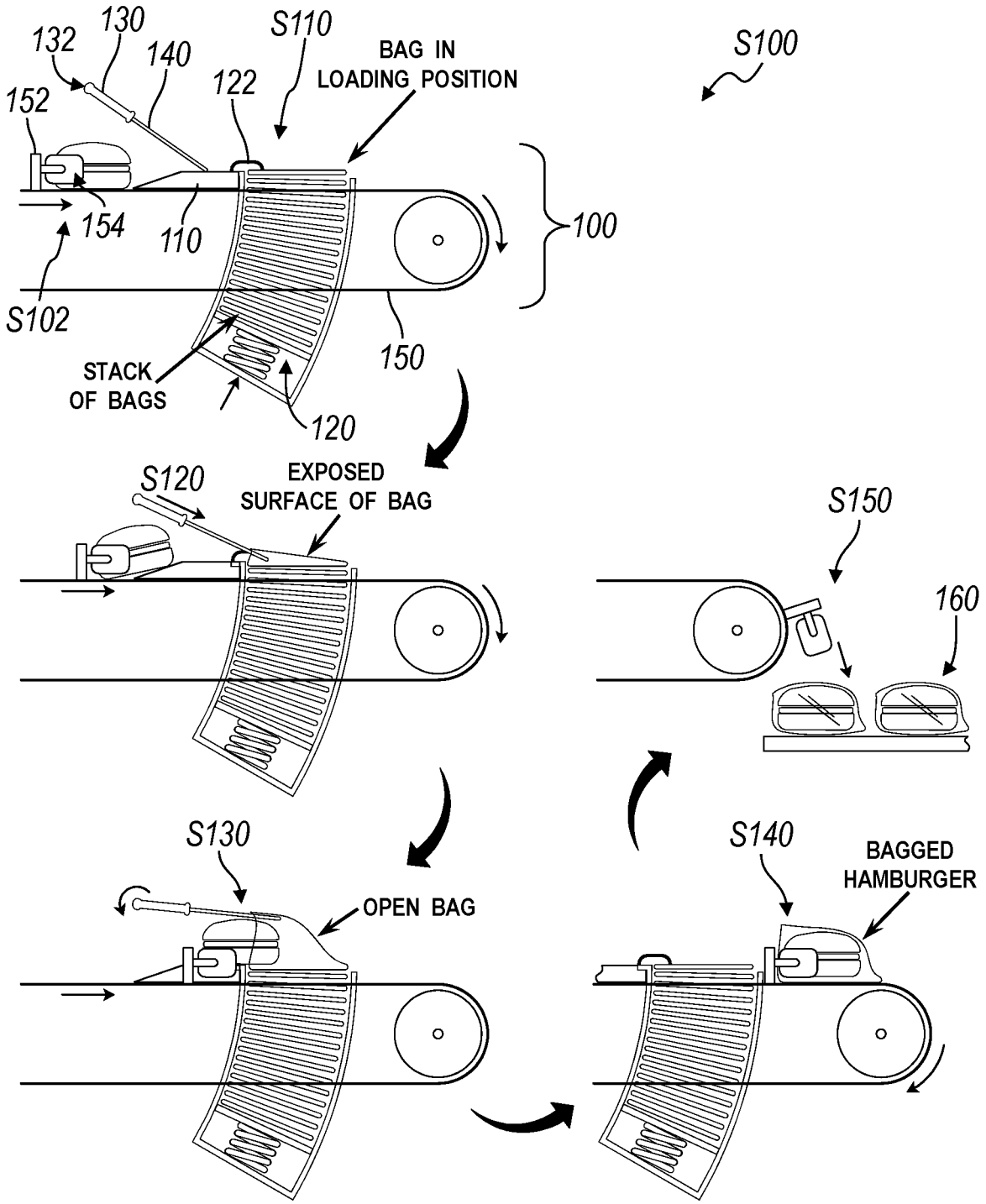
FIG. 1 is a flowchart representation of a method and a system of the invention.
Figure 10:
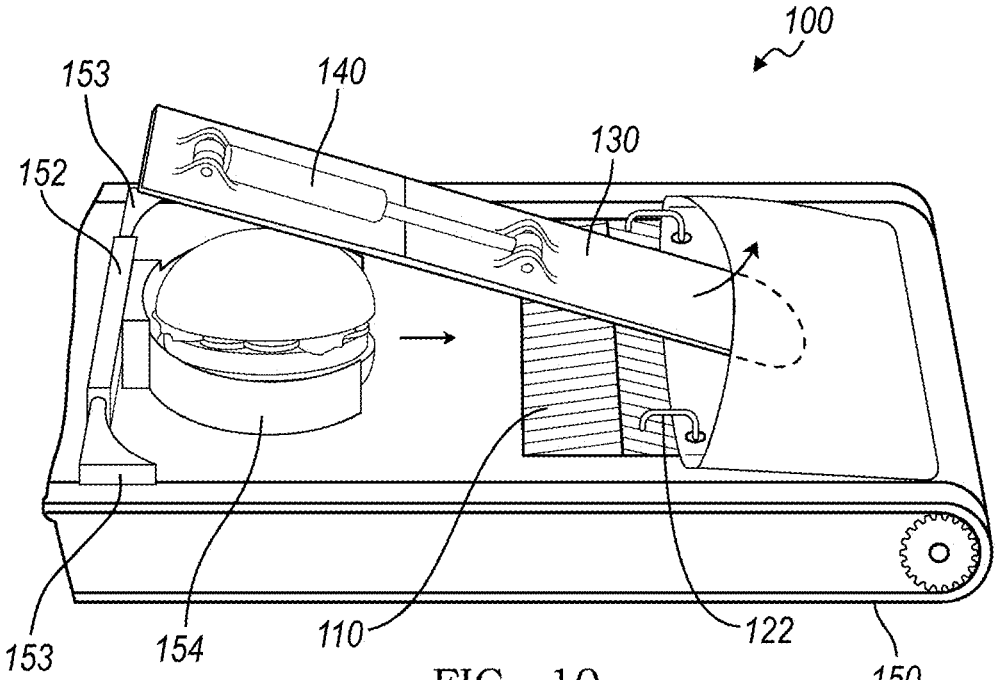
FIG. 10 is a schematic representation in accordance with one variation of the system.

As shown in FIGS. 1 and 10, a system 100 for packaging a foodstuff includes: a ramp 110; a bag dispenser 120 adjacent and aligned longitudinally with the ramp 110 and dispensing a bag into a load position, the bag closed with a mouth of the bag substantially aligned with a top surface of the ramp 110 in the load position; a paddle 130 aligned longitudinally with the ramp 110, pivotable about a hinge 132 arranged above the ramp 110, and including a leading edge opposite the hinge and engaging the ramp 110, the paddle 130 extensible between a retracted setting and an extended setting, the leading edge of the paddle 130 in contact with the ramp 110 in the retracted setting and inserted into the mouth of the bag, in the load position, in the extended setting; an actuator 140 coupled to the paddle 130 and extending the paddle 130 between the retracted setting and the extended setting, the paddle 130 running along the ramp 110 and into the mouth of the bag between the retracted setting and the extended setting; and a conveyor 150 substantially aligned with the ramp 110 and the bag dispenser 120, including a carriage 152 supporting a foodstuff, and advancing the carriage 152 toward the bag dispenser 120, the carriage 152 contacting a bottom surface of the paddle 130 in the extended setting and pivoting the paddle 130 about the hinge, the leading edge of the paddle 130 separating an upper layer of the bag from a lower layer of the bag in response to contact with the carriage 152, the carriage 152 inserting the foodstuff into the bag.

As shown in FIGS. 1 and 10, one variation of the system 100 includes: a ramp 110; a bag dispenser 120 adjacent and aligned substantially longitudinally with the ramp 110 and dispensing a bag into a load position, the bag closed with a mouth of the bag substantially aligned with a top surface of the ramp 110 in the load position; a paddle 130 aligned substantially longitudinally with the ramp 110, including a leading edge inclined toward the ramp 110, and operable between a retracted setting and an extended setting, the leading edge of the paddle 130 in contact with the ramp 110 in the retracted setting and inserted into the mouth of the bag, in the load position, in the extended setting; an actuator 140 coupled to the paddle 130 and transitioning the paddle 130 from the retracted setting into the extended setting, the paddle 130 running along the ramp 110 and into the mouth of the bag between the retracted setting and the extended setting; and a conveyor 150 aligned with the ramp 110 and the bag dispenser 120, supporting a foodstuff, and advancing the foodstuff toward the bag dispenser 120, the leading edge of the paddle 130 displaced by contact between the paddle 130 and the foodstuff and opening the bag in response to advancement of the foodstuff by the conveyor 150, the conveyor 150 inserting the foodstuff along the paddle 130 and into the bag.

Furthermore, as shown in FIG. 1, a method S100 executable by the system 100 to packaging a foodstuff includes: constraining the foodstuff within a receptacle 152 in Block S102; dispensing a bag into a load position within a bag dispenser 120 in Block S110, a mouth of the bag substantially aligned longitudinally with the foodstuff and facing the foodstuff in the load position; separating an upper layer of the bag from a lower layer of the bag across the mouth of the bag in Block S120, the lower layer of the bag constrained in to the bag dispenser 120; advancing the receptacle 152 into a first position to insert the receptacle 152 and the foodstuff into the mouth of the bag in Block S130; with the foodstuff substantially fully contained within the bag, advancing the receptacle 152 forward into a second position in Block S140, the receptacle 152 drawing the bag out of the bag dispenser 120; and releasing the receptacle 152 from the foodstuff to deposit the foodstuff and the bag onto a chute 160 for delivery to a customer in Block S150.

2. Applications

Generally, the system 100 functions to contain a set of fresh bags, to dispense a bag into a load position, to receive a completed hamburger (or other foodstuff), to load the completed hamburger into the bag in the load position, and to dispense the bagged hamburger for delivery to a customer, as shown in FIG. 1. The system 100 can define a bagging subsystem within an automated foodstuff assembly apparatus including one or more other subsystems that prepare, portion, and/or dispense other components of a hamburger (or other foodstuff) and cooperate to assemble a completed hamburger (or other foodstuff) from disparate ingredients, such as described in U.S. patent application Ser. No. 13/911,637, filed 6 Jun. 2013, and U.S. patent application Ser. No. 14/208,149, filed 13 Mar. 2014, which are incorporated in their entireties by this reference. For example, the automated foodstuff assembly system can include a patty grinding subsystem that grinds and presses custom hamburger patties from raw meat (such as based on custom patty orders), a patty grilling subsystem that grills patties (e.g., rare, medium, or well-done based on custom patty orders), a bun toaster subsystem that toasts bun crowns and bun heels, a topping subsystem that loads toppings and condiments onto bun heels (e.g., based on custom topping orders), and the bagging subsystem (i.e., the system 100) that loads completed hamburgers into paper bags for delivery to patrons. The system 100 can therefore be arranged at or near an output end of a conveyor or other conveyance mechanism that moves hamburgers through subsequent assembly stages within the automated foodstuff assembly apparatus to collect patties, toppings, condiments, and bun crowns before inserting the hamburger into a fresh paper bag and dispensing the bagged hamburger from the automated foodstuff assembly apparatus.

The system 100 can package the hamburgers into stock (or standard) paper bags, such as white, wax-coated paper bags approximately four inches square with offset edges on each side of the bags proximal mouths of the bags. The system 100 can additionally or alternatively package hamburgers into custom bags designed for or specific to the system 100. For example, the system 100 can package hamburgers into bags with including custom labels, metallic or conductive inserts, custom holes for alignment in a bag dispenser 120, and/or custom mouth geometries, etc. as described below.

Furthermore, the system 100 can execute the method S100 to automatically load (or "bag") a completed hamburger into a fresh bag prior to delivery of the completed hamburger to a customer. In particular, elements within the system 100 can execute the method S100 to dispense a fresh bag into a load position, to open a mouth of the bag, to insert a freshly cooked and assembled hamburger into the bag, and to dispense the bag—now containing the hamburger—for subsequent delivery to a patron, as shown in FIG. 1.

Though the system 100 and the method S100 and are described herein as packaging hamburgers into bags, the system 100 and the method S100 can similarly package sandwiches, hotdogs, burritos, tacos, wraps, salads, and/or other foodstuffs into bags of the same, similar, or different geometries and materials. The system 100 and the method S100 can also be incorporated into an automated foodstuff machine to package one or more distinct types of foodstuffs, such as hamburger, hamburger and lettuce wraps, or burritos.

3. Bag Dispenser

The bag dispenser 120 of the system 100 is adjacent and aligned longitudinally with the ramp 110 and dispenses a bag into a load position, the bag closed with a mouth of the bag substantially aligned with a top surface of the ramp 110 in the load position. Generally, the bag dispenser 120 functions to dispense a fresh bag into the load position once a previous bag is loaded with a foodstuff (e.g., a hamburger) and drawn out of the bag dispenser 120. The bag dispenser 120 can therefore contain multiple bags, such as in a stack, can incorporate passive or active actuators or features to sequentially guide fresh bags into the load position, and can incorporate geometry to retain a bag in the load position until the bag is loaded with a hamburger and removed from the bag dispenser 120.

In one implementation, the bag dispenser 120 is configured to dispense bags vertically upward. In this implementation, the bag dispenser 120 can be arranged substantially "inside" the conveyor 150—that is, contained substantially within a boundary of the conveyor 150—as shown in FIG. 1, and dispense bags upward into the load position.

Figure 2:
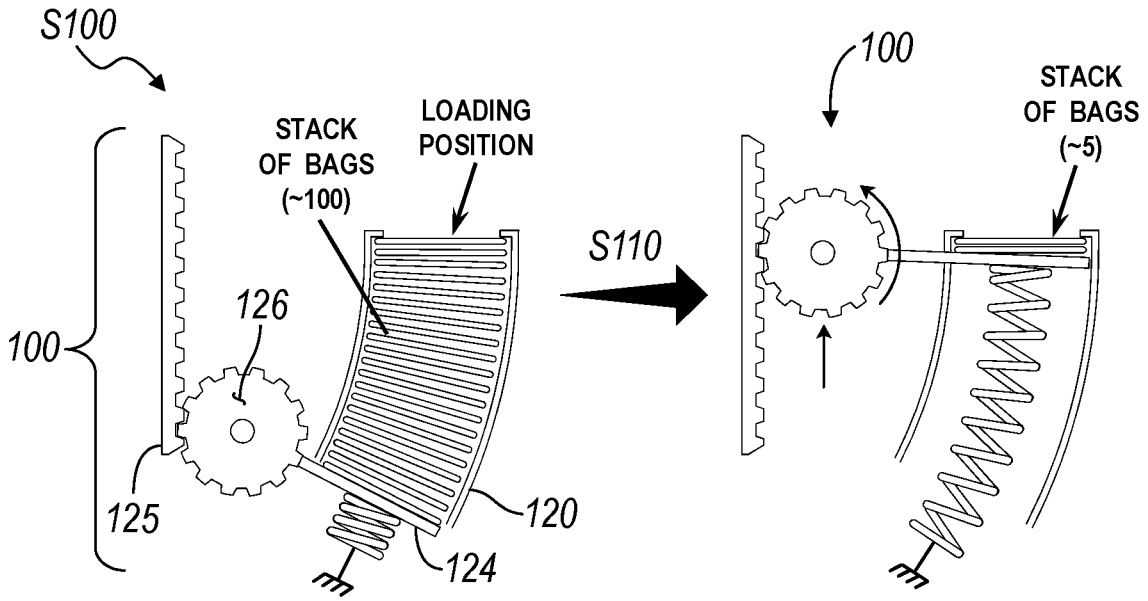
FIG. 2 is a flowchart representation in accordance with one variation of the system and the method.
Figure 4A:
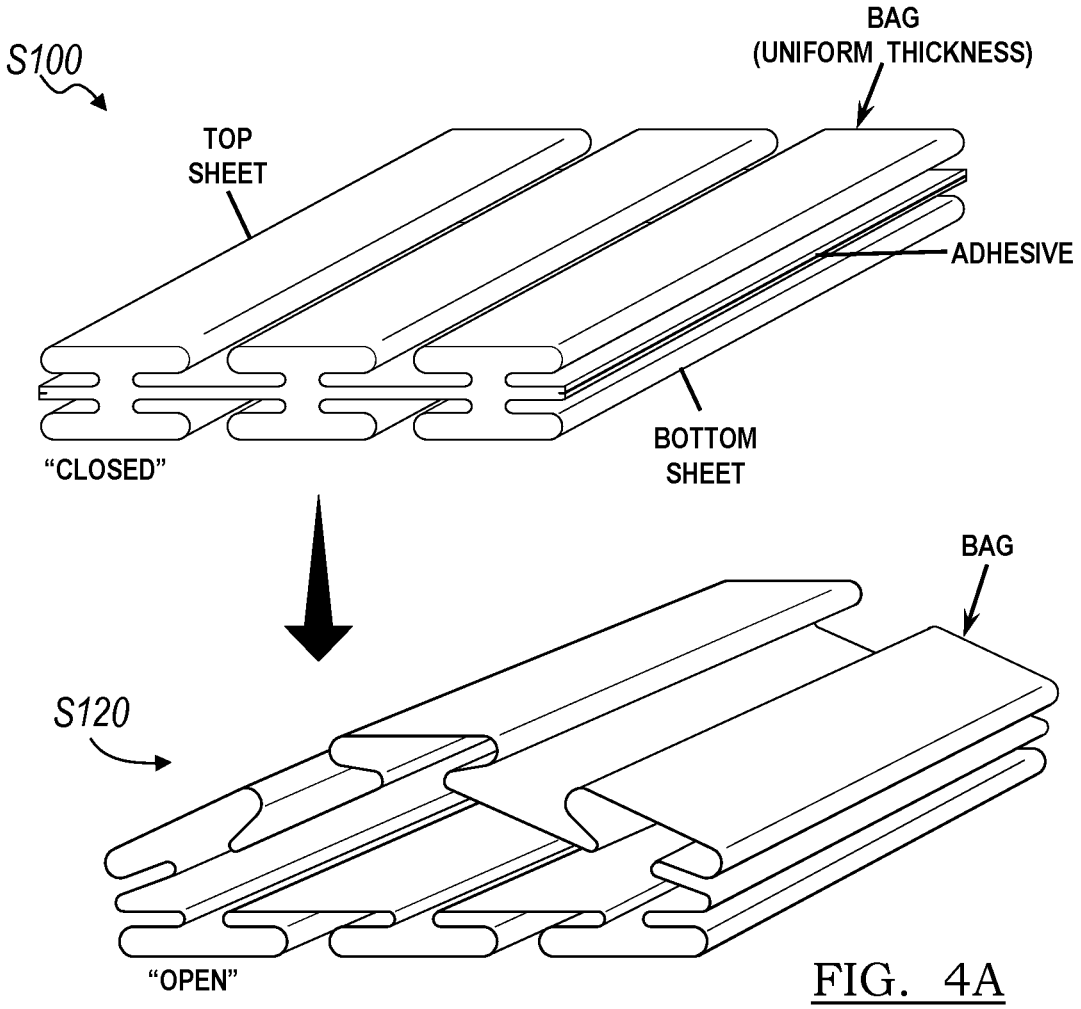
FIGS. 4A and 4B are schematic representations of bag geometries in accordance with variations of the system and the method.
Figure 4B:
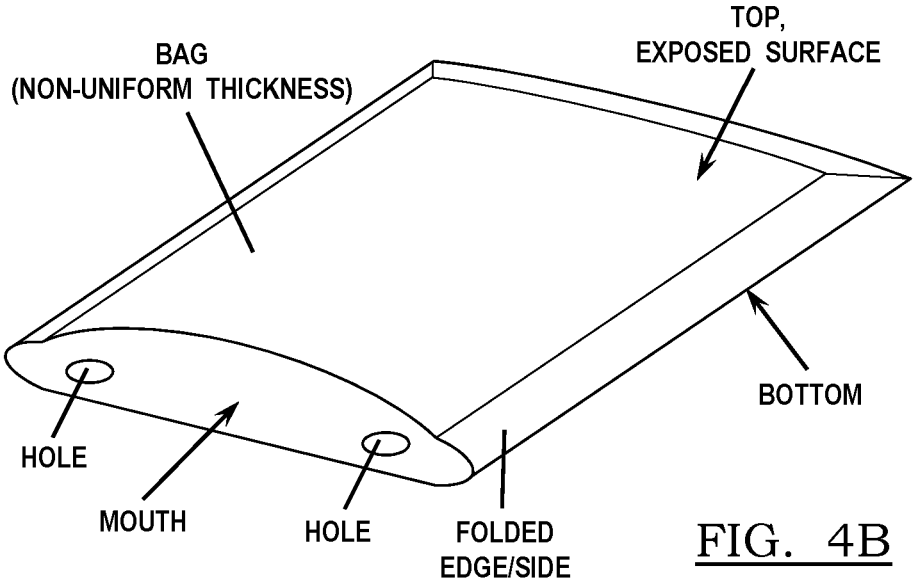
Figure 19:
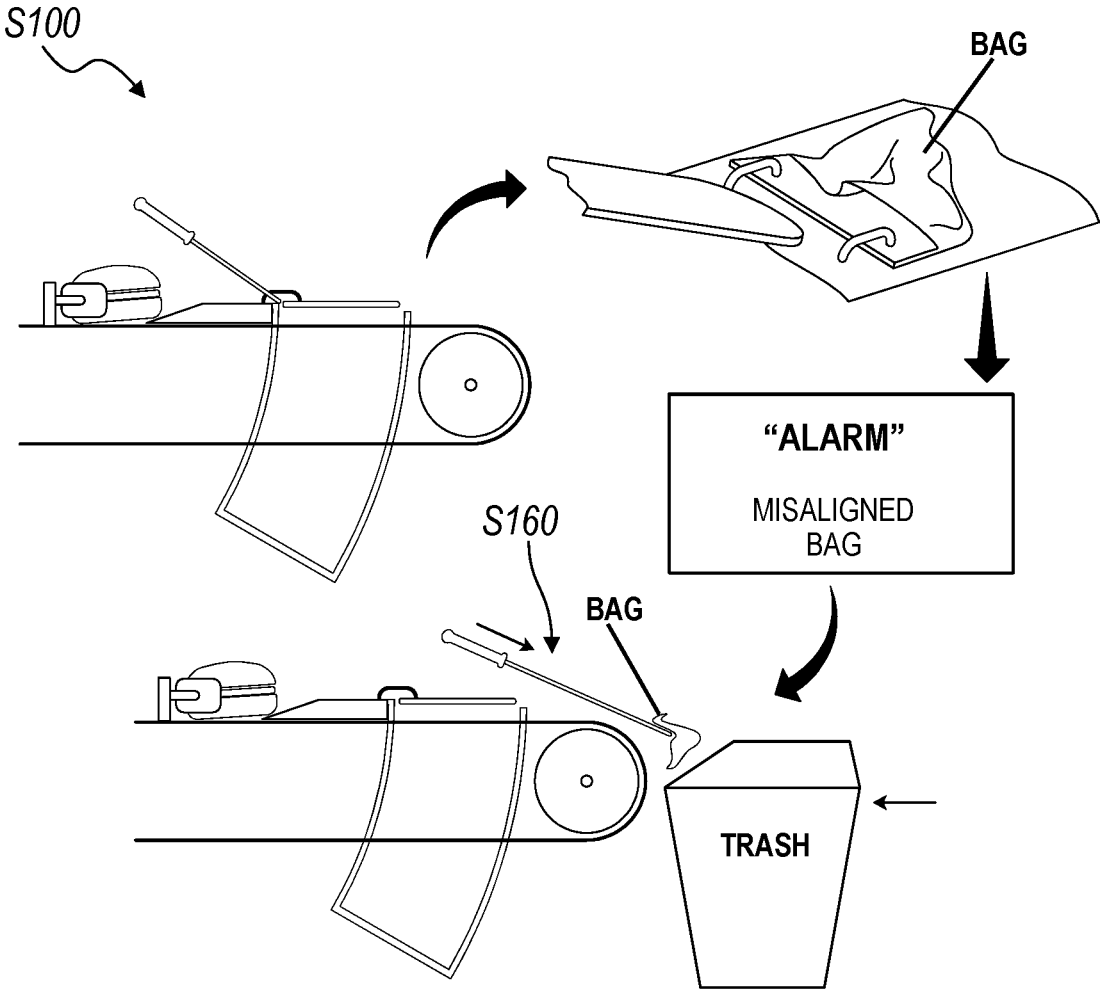
FIG. 19 is a schematic representation in accordance with one variation of the system.

In one example implementation of the foregoing implementation, the bag dispenser 120 dispenses bags of non-uniform bag thickness (shown in FIG. 4B). For example, a bag can be formed from a sheet of wax paper rolled and glued longitudinally near a center of one face of the bag, rolled and glued on a far end to close the far end of the bag, and left open along a mouth of the bag. The bag can also be folded along its sides to enable the bag to expanded open, thereby yielding a suitable internal volume to accept a hamburger. The bag can thus exhibit a greater thickness along its far end than along its mouth and greater thicknesses along its sides than near is center such that a stack (e.g., one hundred) of such bags loaded into the bag dispenser 120 bags—with mouths of the bags arranged in the same direction—exhibits a keystone profile, a side of the stack along mouths of the bags relatively "shorter" that a side of the stack defined by far ends of the bags. In this example implementation, the bag dispenser 120 can thus both rotate and translate the stack of bags upward toward the load position to compensate for the non-uniform thickness of the bags loaded into the bag dispenser 120. For example, the bag dispenser 120 can include a gear rack 125, a pinion 126, and a platen arranged under the load position (and/or under the ramp 110, described below). In this example, the gear rack 125 can be arranged in a substantially vertical orientation below the ramp 110; the pinion 126 can run in the gear rack 125; and the platen can define a substantially planar platform 124 extending from the pinion 126, supporting the stack of bags below the load position, and pivoting about the pinion 126 and translating linearly along the rack 125 to dispense a bag—at a top of the stack of bags—into the load position, such as shown in FIGS. 2 and 19. In this example, the bag dispenser 120 can include a spring, a counterweight, a pneumatic or electromechanical ram, or any other suitable actuator that lifts platen to elevate a subsequent bag into the load position as a previous bag is drawn out of the bag dispenser 120.

Figure 3A:
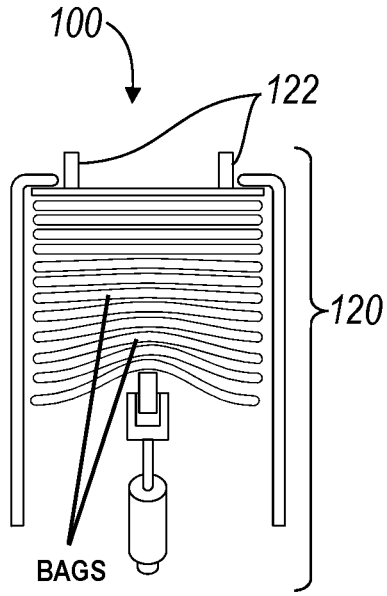
FIG. 3A is a schematic representation in accordance with one variation of the system.
Figure 3B:
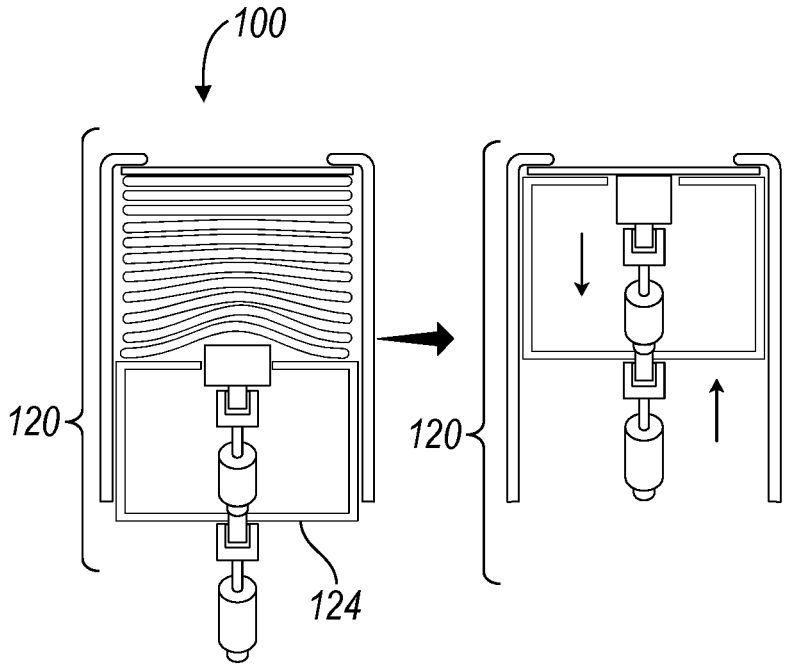
FIG. 3B is a flowchart representation in accordance with one variation of the system and the method.

Furthermore, in the foregoing example implementation in which a bag loaded into the bag dispenser 120 is thicker along its lateral edges) than at or around its center, a stack of these bags may exhibit a total height proximal its center less than its total height along its lateral edges; the bag dispenser 120 can therefore incorporate a static or dynamic feature under the stack of bags to raise the center of the stack of bags such that the center and lateral sides of a bag in the load position are substantially planar, that is, such that a bag currently in the load position is substantially planar and flat prior to opening, such as by the paddle 130 in Block S120. In one example, the bag dispenser 120 includes a platform 124 arranged under and supporting (vertically) a stack of bags, the platform 124 defining an undulating profile with a peak along its center axis, substantially parallel a direction of motion of the conveyor 150, and substantially aligned with a longitudinal center of the stack of bags, such as shown in FIG. 3A. In another example, the platform 124 features a bore along its center axis parallel the direction of motion of the conveyor 150, and the bag dispenser further includes a guide block that is dynamically lowered (and raised) within the bore relative to the platform 124 as the platform 124 is raised (and lowered), thus dynamically adjusting an offset between the platform 124 that supports the edges of the stack of bags and the guide block that supports the center of the stack of bags as each subsequent bag is dispensed and a new bag is are moved into the load position, as shown in FIG. 3B. In this example, the platform 124 and the guide block can thus cooperate to maintain each subsequent bag—in the stack of backs contained in the bag dispenser 120—in a substantially flat, planar form across its exposed surface once moved into the load position.

Alternatively, the bag dispenser 120 can be configured to receive and to dispense bags of substantially uniform bag thickness. For example, the system 100 can load a recently-assembled hamburger into a custom bag, such as a custom bags including a pair of rectangular folded sheets bonded together along three sides with a food-safe adhesive, each rectangular folded sheet including a series of linear folds along its length perpendicular to the mouth of the bag, as shown in FIG. 4A. In this example implementation, a stack of such customs bags may thus be substantially rectilinear in form, including substantially straight along its sides and substantially planar across its top and bottom due to the substantially uniform thickness of each customer bag across its breadth; the bag dispenser 120 can thus index the stack of custom bags substantially linearly (e.g., vertically) toward the load position to shift each subsequent custom bag in the stack into the load position as a previous custom bag is removed from the bag dispenser 120 upon insertion of a corresponding hamburger (or other foodstuff).

Figure 5:
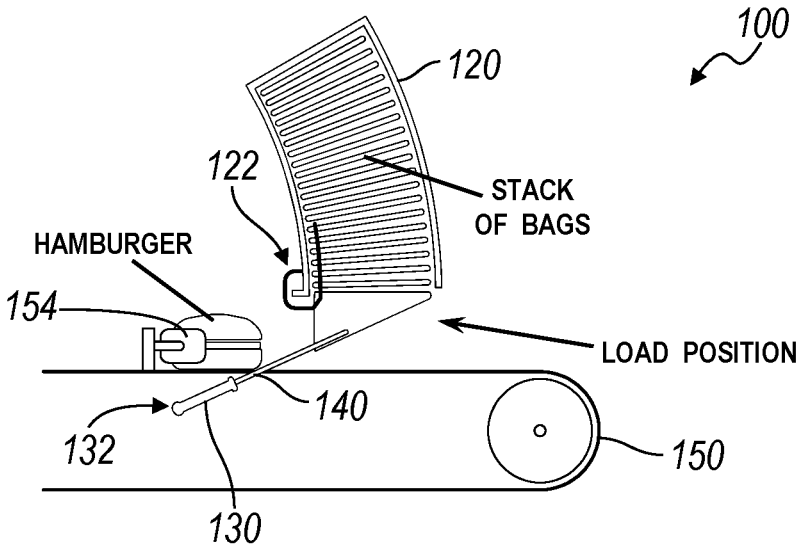
FIG. 5 is a schematic representation in accordance with one variation of the system.

In an alternative implementation, the bag dispenser 120 is configured to dispense bags downward. In this implementation, the bag dispenser 120 can be arranged substantially "outside" of the conveyor 150—that is, contained substantially outside of the boundary of the conveyor 150—as shown in FIG. 5. In this implementation, the bag dispenser 120 can guide a new bag—in a stack of bags loaded into the bag dispenser 120—downward into the load position as each previous bag is drawn out of the bag dispenser 120, such as by a previous carriage 152 or a previous hamburger.

In one example implementation in which the bag dispenser 120 dispenses bags of non-uniform thickness, as described above, the bag dispenser 120 can include a hopper defining an arcuate in profile, as shown in FIG. 5, to accommodate a keystone (or similar) shape of the stack of bags loaded thereinto. Alternatively, the bag dispenser 120 can dispense bags of substantially uniform thickness, such as described above, and the bag dispenser 120 can thus include a hopper defining a relatively straight or rectilinear profile.

In the foregoing implementation, the bag dispenser 120 can feed fresh bags into the load position via gravity. For example, the bag dispenser 120 can include a weight (e.g., a free weighted platen or piston) that rests on the top of the stack of bags to force the stack of bags downward, therefore motivating a bag at the bottom of the stack into the load position. Alternatively, the bag dispenser 120 can include a pneumatic ram, an electromechanical linear actuator, or any other suitable actuator arranged over the stack of bags (e.g., within the hopper) and configured to actively drive the stack of bags through the hopper and toward the load position. For example, the bag dispenser 120 can include a pneumatic ram that applies a downward force to a piston running in the hopper over the stack of bags, and the bag dispenser 120 can execute Block S110 (described below) to manipulate air pressure supplied to the pneumatic ram to maintain a substantially constant aggregate force on a bag at the bottom of the stack and entering the load position as each successive bag in the stack of bags in shifted into the load position. In particular, the bag dispenser 120 can adjust (e.g., increase) a force applied by the pneumatic ram onto the piston to compensate for a reduced total weight of the stack as successive bags are drawn out of the bag dispenser 120.

However, the bag dispenser 120 can include a hopper of any other form and arranged in any other way fully or partially inside or outside of the conveyor 150, and the bag dispenser 120 can execute Block S110 in any other way to control dispensation of each successive bag into the load position.

Figure 13:
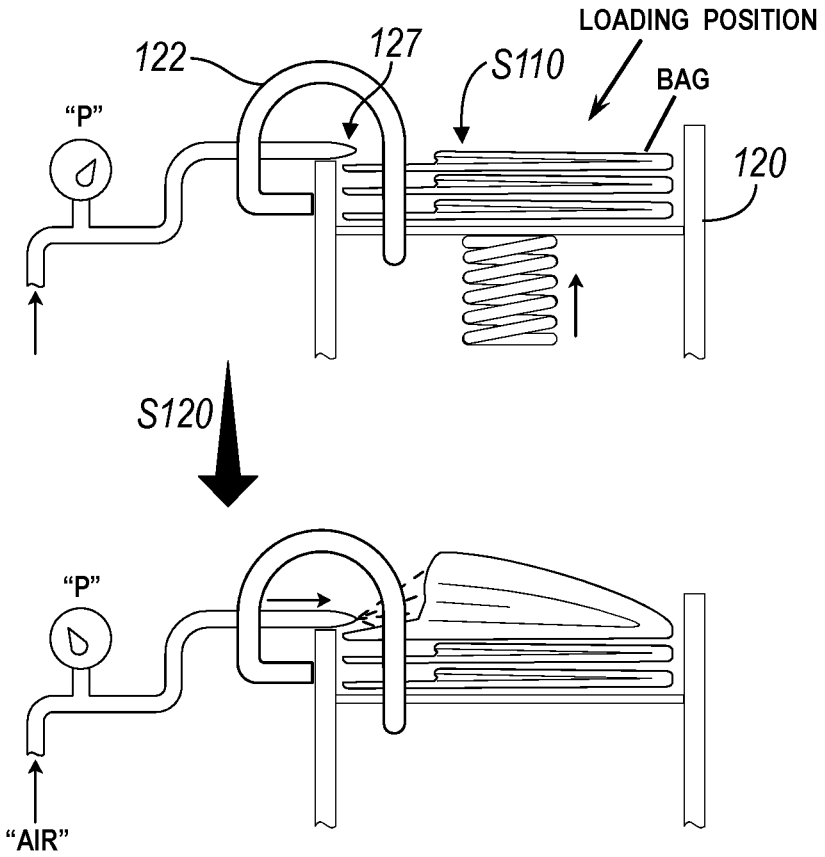
FIG. 13 is a flowchart representation in accordance with one variation of the system and the method.

The bag dispenser 120 can also include a hook 122 (or post, stud, pin 122, etc.) to engage a hole (i.e., bore) in each bag in the stack of bags loaded into the bag dispenser 120. For example, each bag loaded into the bag dispenser 120 can feature a pair of holes near its mouth and spaced apart by a width greater than a typical or maximum width of a hamburger assembled within the automated foodstuff assembly apparatus, and bag dispenser can feature a pair of pins extending from a base of the hopper (containing the bags) toward and passed the load position, the pins passing through the bores in the bags, and the conveyor 150 executing Block S130 of the method S100 to sequentially advance hamburgers between the pair of pins and into corresponding bags. In this example, the conveyor 150 can continue to advance a hamburger forward once inserted into a bag thus retained by the pair of pins—as in Block S140—to tear the bag around the pins, thereby releasing the bag from the bag dispenser 120; the bag dispenser 120 can thus load a subsequent bag into the load position, and the pair of pins can similarly retain the subsequent bag. In this example, the pair of pins can alternatively extend a minimal distance past a plane of a flat bag in the load position such that the holes in a bag are elevated off of the pins when deformed during insertion of a hamburger into the bag. In another example, the bag dispenser 120 can incorporate a hook 122 supported off of a side of the hopper and looping downward (or upward for the bag dispenser 120 that dispenses bags downward) toward a platform 124 at the base of the hopper. In this example, a portion of the hook 122 extend downward toward the base of the hopper can be of a minimal length (e.g., 1.0") to engage bores in bags at the top of the stack of bags loaded into the hopper, as shown in FIGS. 19 and 13, and the platform 124 can sequentially elevate additional bags into the hook 122 as bags at the top of the stack are drawn out of the bag dispenser 120. Alternatively, the hook 122 or pin(s) can pass fully through the stack of bags, such as supported by the ramp 110 adjacent the bag dispenser 120 and extending downward passed the platform 124 of the hopper in the fully-loaded position. Similarly, a stack of bags can be assembled into a pair of hooks before being loaded into the bag dispenser 120, and the hooks can be (manually) set in place in corresponding receptacles—such as defined in the ramp 110 adjacent the bag dispenser 120 or inside the hopper—to reload the bag dispenser 120 with a fresh stack of bags. In this example, the hooks can then be removed from their corresponding receptacles and a new assembly of hooks and bags installed in the bag dispenser 120. The bag dispenser 120 can thus include one or more hook 122, pins, or other similar features transiently or fixedly coupled to a hopper containing one or more bags to laterally and/or longitudinally retain the bags once in the load position as hamburgers are sequentially loaded into the bags.

Figure 6:
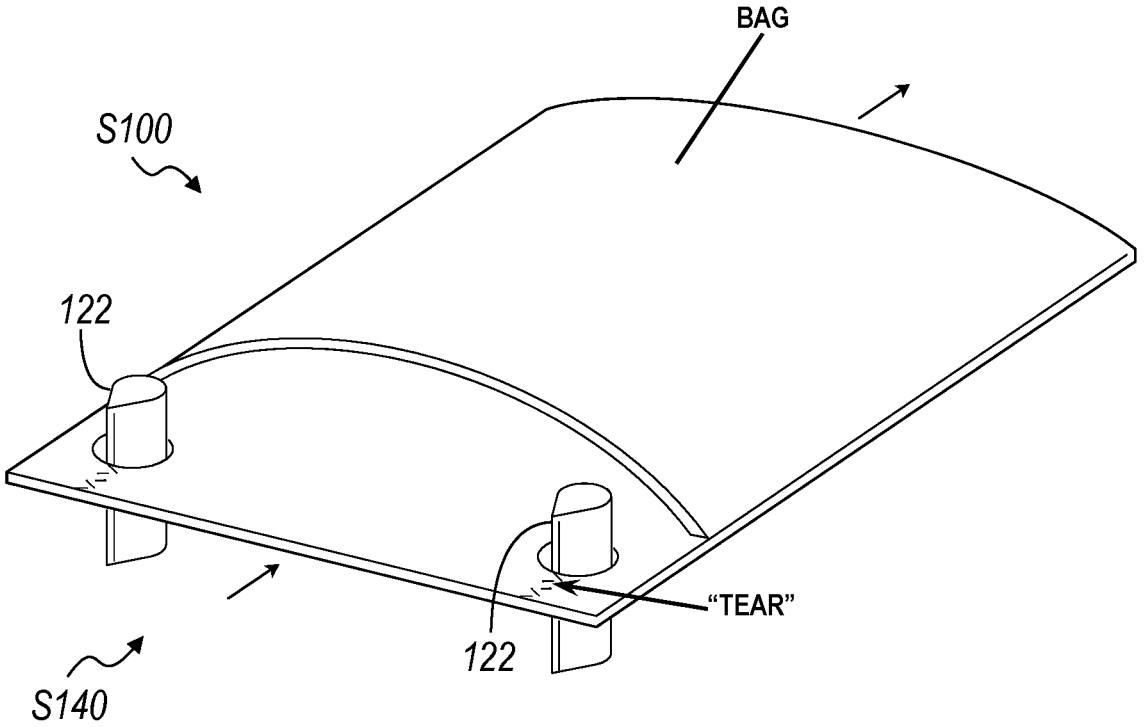
FIG. 6 is a schematic representation in accordance with one variation of the system.

In the foregoing implementation, the bag dispenser 120 can incorporate one or more pins, hooks, or similar features that are circular in cross-section, tapered in cross-section, define a knifed edge, or are of any other suitable geometry or cross-section. For example, as shown in FIG. 6, the bag dispenser 120 can include a pair of pins, each defining a sharp (knife-edged) taper facing the ramp 110, the sharp edges of the tapered pins cutting bags around their corresponding bores as the conveyor 150 advances hamburgers forward into the bags and then pulls the bags out of the bag dispenser 120, as in Block S140. The pin(s) can therefore function to align the stack of bags and to retain a bag in the load position until the bag is filled with a hamburger and ripped off of the pin(s), as in Blocks S120, S130, and S140. However, the pins can be of any other form and supported in any other way within the bag dispenser 120.

In the foregoing implementation, the bag dispenser 120 can be configured to dispense a bag that includes a section along its bottom layer that extends beyond its top layer across the mouth of the bag (or vice versa for a bag dispenser 120 than dispenses bags downward) as shown in FIG. 6, and the extended section of the bottom layer of the bag define one or more bores that are engaged by the pin(s), hooks, or other retention and/or alignment features incorporated into the bag dispenser 120, as shown in FIG. 4B. However, the bag dispenser 120 can be configured to accept and dispense bags of any other form or geometry.

The bag dispenser 120 can also include a lip extending from the ramp 110 toward the bag, the lip retaining a lower layer of a bag—in the load position—along the mouth of the bag, as shown in FIG. 10. In this implementation, the bag dispenser 120 can include a lip arranged across its input end and configured to retain the extended section of the bottom layer of a bag in the load position, as described above. The leading edge of the paddle 130 can thus run along the lip, onto the bottom layer of the bag, and then between the top layer and the bottom layer of the bag as the paddle 130 is transitioned between the retracted setting and the extended setting in Block S120, the lip thus preventing the paddle 130 from catching on the leading edge of the bottom layer of the bag and dislodging the bag from the bag dispenser 120 between the hamburger is loaded thereinto.

In a similar implementation, the bag dispenser 120 can additionally or alternatively define a lip extending longitudinally along each side of the outlet of the hopper and across the load position, the lips configured to retain the left and right sides of a bag in the load position. For example, the bag dispenser 120 can be configured to dispense a bag featuring a set of folds on its left and on its right side, left and right folds along the top surface of the bag (i.e., the exposed surface of the bag in the load position) inset from adjacent folds of the bag along its bottom surface (i.e., a surface facing a top surface of a lower bag in the stack of bags), such as shown in FIGS. 3A and 3B. In this example, the left and right folds along the top surface of a bag in the load position can extend to receive a hamburger as the conveyor 150 advances the hamburger forward, as in Block S130 of the method S100, and the conveyor 150 can then execute Block S140 to draw the left and right folds along the bottom surface of the bag out from the two lips to free the bag from the dispenser.

The bag dispenser 120 can similarly include a set of rollers—with axes perpendicular to the direction of motion of the conveyor 150—arranged along the load position of the bag dispenser 120. In this implementation, the rollers can function like the pair of lips described above to retain the opposing edges of folds along the sides of a bag in the load position until the bag is pulled out of the bag dispenser 120 by the conveyor 150, as in Block S140. However, the bag dispenser 120 can include any other component or feature to guide a bag into the load position and to support and/or retain the bag in the load position.

The bag dispenser 120 can therefore execute Block S110 of the method S100, which recites dispensing a bag into the load position, a mouth of the bag substantially aligned longitudinally with a foodstuff and facing the foodstuff in the load position. Generally, the bag dispenser 120 executes Block S110 to move bags into position to be opened (in Block S120) to accept hamburgers (in Block S130) as subsequent hamburgers are conveyed into the system 100, bagged, and dispensed or delivery to customer. For example, the bag dispenser 120 can actively implement Block S110 by activating an actuator—such as according to closed feedback control—coupled to the platen supporting a stack of bags to elevate the platen toward the load position, thereby shifting a bag arranged at the top of the stack of bags into the load position and aligning the bag with an advancing hamburger.

Figure 11:
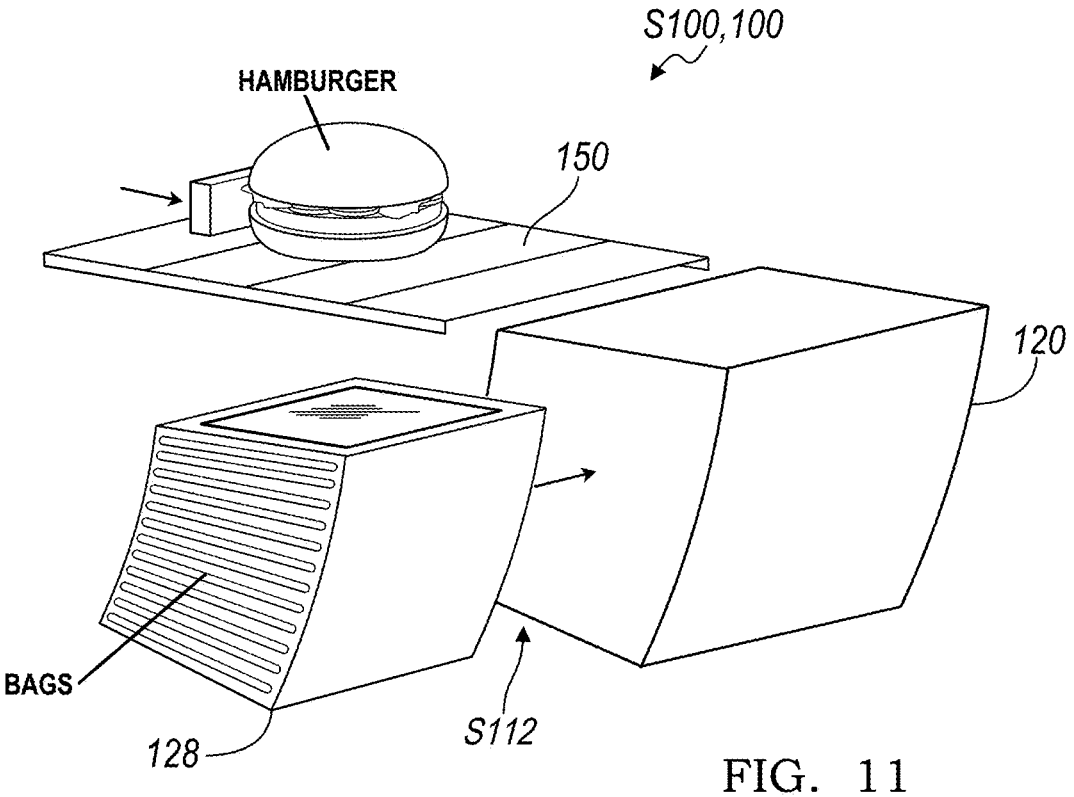
FIG. 11 is a schematic representation in accordance with one variation of the system and the method.

As shown in FIG. 11, one variation of the bag dispenser 120 further executes Block S112, which recites loading a set of bags into a bag dispenser 120. In this variation, the bag dispenser 120 can execute Block S112 by interfacing with a reloading subsystem arranged within the automated foodstuff assembly apparatus to shift a fresh stack of bags into the hopper. For example, for the hopper configured to receive a stack of bags retained by a hook 122 or pin 122 extending through the stack of bags, as described above, the bag dispenser 120 can implement Block S112 to dispel a spent hook 122 from the hopper and to transition a fresh hook 122 and bag stack into position within the hopper. For example, the reloading subsystem can include a magazine of bag stacks coupled to a linear actuator, and the bag dispenser 120 can index the magazine forward to load a new stack of bags laterally into the hopper, as in Block S112, once a previous stack of bags expires.

In the implementations described above in which bags are dispensed into the load position from the bottom up (shown in FIG. 1), the bag dispenser 120 can execute Block S112 to load a fresh stack of bags into the hopper longitudinally or downwardly. For example, the reloading subsystem can include a secondary dispenser arranged above the hopper bag dispenser and configured to dispense a stack of bags into the hopper once the hopper is emptied. In this example, the bag dispenser 120 can trigger one or more alignment pins (described above) to rotate into a reload position, the secondary dispenser shift down into a dispense position over the (empty) hopper. The secondary dispenser can then release bags from the secondary dispenser into the hopper as the bottom of the hopper (e.g., the platform 124) lowers. Once a target number of bags have been dispensed and/or once the hopper is full, the secondary dispenser can retract, and the pin(s) can return to a dispense position. The platform 124 within the hopper can also rise to engage holes in the bags contained therein with the pin(s). Alternatively, the pin(s) can be retracted axially into the reload position before the hopper is reloaded, and the pins can be driven axially back into the dispense position once the stack of bags is loaded into the hopper. Yet alternatively, once the hopper is emptied, the pins can be driven axially from the hopper into the secondary dispenser to engage corresponding holes in bags contained in the secondary dispenser, the secondary dispenser can release a series of bags, and the pins can guide the series of bags into the hopper and then retract into once the hopper is fully or sufficiently reloaded with fresh bags.

In another implementation, the bag dispenser 120 can execute Block S112 to feed a stack of fresh bags laterally into the hopper. For example, the bag dispenser 120 can execute Block S112 by controlling various actuator integrated thereinto: to drive a bottom of the hopper (i.e., platform 124) into a fully-retracted position (e.g., fully downward) once the hopper is (sufficiently) emptied; to open a door on a lateral side of the hopper; to retract one or more pins from the hopper or to transition the pin(s) into a reload position; to insert a fresh stack of bags laterally into the hopper, such as from a magazine of fresh bags; to transition the one or more pins back into a dispense position; to close the door of the hopper; and to raise the platform 124 within the hopper until the pins engage corresponding bores in the bags now loaded into the hopper and to move a top bag in the stack of bags in to the load position (as in Block S110).

In another example in which the bag dispenser 120 dispenses bags featuring a notch, groove, or other feature along its perimeter (e.g., on its left and right edges), the bag dispenser 120 can include a pin 122, guide, rail, or other mechanism or feature that engages this feature in bags loaded into the hopper to align these bags. In this example, a first rail can be mounted on a door of the hopper, a second rail can be mounted at a far side of the hopper opposite the door, and the bag dispenser 120 can execute Block S112 to open the door, insert a stack of bags into the hopper with the stack of bags engaging the second rail, and then close the door such that the first rail coupled to the door engages the corresponding feature defined by the stack of bags.

In yet another implementation, the hopper can be configured to accept a bag cartridge 128, the bag dispenser 120 can execute Block S112 to replace a spent bag cartridge 128 with a full bag cartridge 128 filled with fresh bags. For example, the secondary dispenser can be configured to index a full bag cartridge 128 laterally and into the hopper to both expel a spent bag cartridge 128 out of the hopper and to load a fresh (i.e., full) bag cartridge 128 into the hopper. In this implementation, a bag cartridge 128 containing a stack of bags can define a keystone geometry, as described above, with open top and sides to accommodate bags of non-uniform thickness, and the cartridge 128 can engage one or more features in the hopper to lock into position once inserted therein in Block S112, such as shown in FIG. 11.

Yet alternatively, the bag dispenser 120 can reset a position of the hopper to accept new bags or a fresh cartridge 128 and then prompt manual reload of the hopper with a stack of fresh bags or a full bag cartridge 128, such as by triggering an alarm or triggering delivery or an electronic communication to an operator of the automated foodstuff assembly apparatus in Block S112.

However, the bag dispenser 120 can include any other suitable type of reloading subsystem and can execute Block S112 in any other way to reload the hopper with fresh bags or prompt manual reload of fresh bags into the hopper.

4. Ramp

The system 100 also includes a ramp 110 arranged ahead of the bag dispenser 120. Generally, the ramp 110 is functions to support the leading edge of the paddle 130 as the paddle 130 is driven toward and into the bag, as in Block S120. For example, the ramp 110 can be physically coextensive (i.e., define a unitary structure) with the lip of the bag dispenser 120 arranged along the inlet side of the bag dispenser 120 at the load position.

Figure 8:
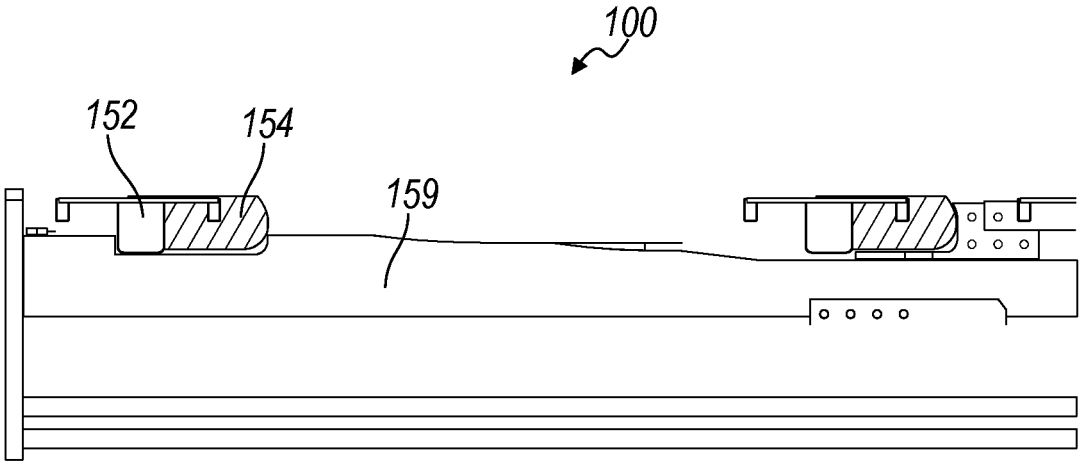
FIG. 8 is a schematic representation in accordance with one variation of the system.
Figure 9:
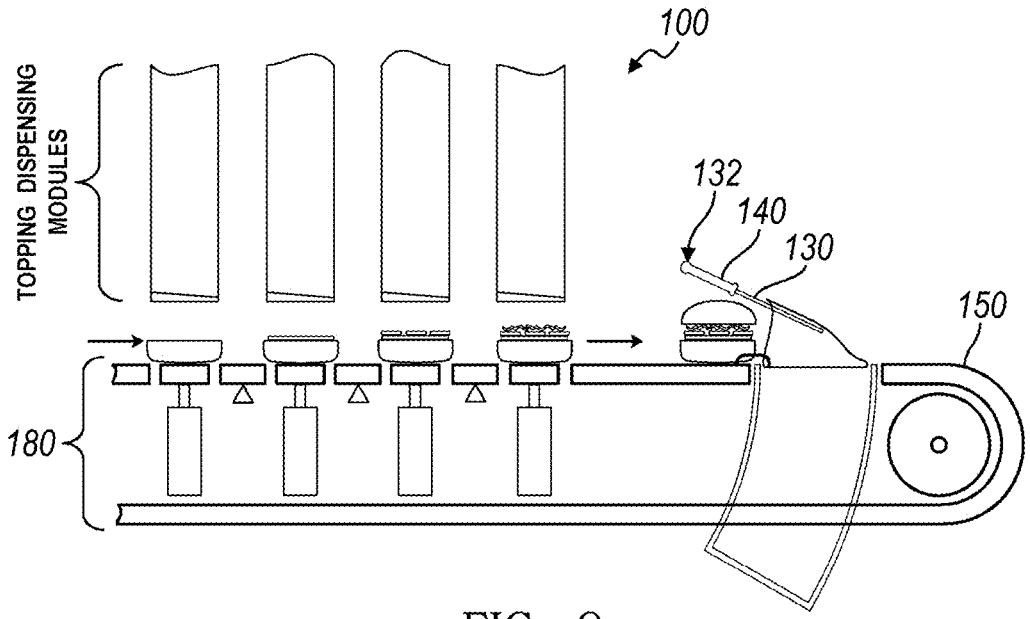
FIG. 9 is a schematic representation in accordance with one variation of the system.

In one implementation in which the bag dispenser 120 dispenses bags upwardly, the ramp 110 can be arranged substantially inline with the conveyor 150 and below the paddle 130. In this implementation, the ramp 110 can also provide vertical support to hamburger as the conveyor 150 advances hamburger forward toward the bag dispenser 120, such as shown in FIGS. 1 and 8 and as described below. Therefore, because the ramp 110 contacts hamburgers (or other foodstuffs) directly, the ramp 110 can include a food-safe material along its upper surface that supports hamburger as the conveyor 150 shuttles the hamburgers toward the bag dispenser 120. (The lip, pins, hooks, and/or other components of the bag dispenser 120 can incorporate similar food-safe materials.)

Alternatively, in one implementation in which the bag dispenser 120 dispenses bags downwardly, the ramp 110 can be arranged just ahead of the bag dispenser 120 over the conveyor 150 and above the paddle 130, such as shown in FIG. 5. In this implementation, the ramp 110 can thus function as a track to guide the leading edge of the paddle 130 toward the bag dispenser 120.

5. Paddle And Actuator

The paddle 130 of the system 100 is aligned longitudinally with the ramp 110, is pivotable about a hinge 132 arranged above the ramp 110, and includes a leading edge opposite the hinge and engaging the ramp 110, the paddle 130 extensible between a retracted setting and an extended setting, the leading edge of the paddle 130 in contact with the ramp 110 in the retracted setting and inserted into the mouth of the bag, in the load position, in the extended setting. The actuator 140 of the system 100 is coupled to the paddle 130 and extends the paddle 130 between the retracted setting and the extended setting, the paddle 130 running along the ramp 110 and into the mouth of the bag between the retracted setting and the extended setting. Generally, the actuator 140 functions to transition the paddle 130 into the extended setting to insert the leading edge of the paddle 130 into the mouth of a bag in the load position, and the paddle 130 functions to separate adjacent layers of the bag to enable the hamburger (or other foodstuff) to be inserted in to the bag. In particular, the paddle 130 can be supported on its trailing end (opposite the leading edge) by a hinge 132 and can thus pivot as the leading edge of the paddle 130 runs along the ramp 110 when the actuator 140 transitions the paddle 130 from the retracted setting into the extended setting. As the paddle 130 is contacted by the conveyor 150, a carriage 152 on the conveyor 150, a finger suspended from a carriage 152 on the conveyor 150, or directly by a hamburger advanced toward the bag by the conveyor 150, the paddle 130 can further pivoted about the hinge as the leading edge of the paddle 130 translates away from the bag dispenser 120 to further open the mouth of the bag in preparation to receive the hamburger. The leading edge of the paddle 130 can therefore run along the ramp 110, over the lip, and into the mouth of a bag—in the load position—between a lower layer of the bag and an upper layer of the bag as the paddle 130 transitions from the retracted setting into the extended setting.

In one implementation in which the bag dispenser 120 dispenses bags from the bottom up (as described above), the trailing end of the paddle 130 is hinged over the conveyor 150 with ample space for a completed hamburger to pass between the conveyor 150 (and/or the ramp 110) and the paddle 130. In this implementation, when the paddle 130 is retracted, the leading edge of the paddle 130 rests on the ramp 110. The system 100 can thus execute Block S120 to trigger the actuator 140 to extend a length of the paddle 130, thereby causing the paddle 130 to rotate about the hinge driving the leading edge of the paddle 130 forward along the ramp 110 and into the mouth of a bag in the load position, as shown in FIG. 1. With the paddle 130 extended and the leading edge of the ramp 110 resting inside the bag, such as under a free lip of the bag, the system 100 can trigger the conveyor 150 to advance forward, as in Block S130, to drive a completed hamburger forward toward the paddle 130. As the conveyor 150 advances, the top of the hamburger can contact and slide along the underside of the paddle 130, pivoting the paddle 130 about the hinge and elevating the leading edge of the paddle 130 to open the bag, as shown in FIG. 1. Alternatively, one or more fingers supporting the hamburger on the conveyor 150 (shown in FIG. 6) can contact the paddle 130 to pivot the paddle 130, thereby opening the bag as the conveyor 150 advances forward.

In a similar implementation, the bag dispenser 120 is substantially inverted and dispenses bags downward into the load position, as shown in FIG. 5, and the system 100 can similarly trigger the actuator 140 to extend the paddle 130 forward and into the mouth of the bag, as in Block S120. In this implementation, the paddle 130 can be actively or passively inclined upward and held in contact with the ramp 110, such as by a spring or a counterbalance, electromechanical actuator, or other force applicator. The conveyor 150 can then drive the hamburger forward vertically between the paddle 130 and ramp, and the conveyor 150, carriage 152, fingers or other component of the conveyor 150 and/or the hamburger directly can contact the paddle 130 to counter the force applicator, thereby pivoting the paddle 130 to open the bag, as to the foregoing implementation.

The paddle 130 can therefore incorporate a hinged component defining the trailing edge of the paddle 130 and constrained in translation and in two degrees of rotation within the automated foodstuff assembly apparatus. The paddle 130 can therefore also include an interaction component coupled to the hinged component and free to translate longitudinally relative to the hinged component. The actuator 140 can thus be coupled on one end to the hinged component and on an opposite end to the interaction component, thereby extending and retracting the interaction component relative to the hinged component when activated. Alternatively, the actuator 140 can be pivotably coupled to a rigid frame, crossmembers, or other structure within the system 100 or within the automated foodstuff assembly apparatus and can be pivotably coupled on an opposite end to the interaction component, thereby extending and retracting the interaction component relative to the hinged component when activated. The actuator 140 can thus function to increase and decrease a total effective length of the paddle 130 by transitioning the paddle 130 into the extended setting and into the retracted setting, respectfully.

In the foregoing implementation, the trailer edge of the paddle 130 can additionally or alternatively be supported along a linear or curvilinear slide (or by a similar linkage), and the actuator 140 can motivate the trailing end of the paddle 130 forward along the slide to transition the paddle 130 between the retracted setting and the extended setting. In this implementation, contact by the conveyor 150, the carriage 152, the hamburger, etc. on the paddle 130 can further shift the trailing end of the paddle 130 along the slide as the leading edge of the paddle 130 separates adjacent layers of the bag. For example, the paddle 130 can define a fixed length, the trailing end of the paddle 130 can be hinged and can run inside a linear slide supported over the conveyor 150, the slide constraining translation of the trailing edge of the paddle 130 to a linear direction longitudinally aligned with and inclined over the conveyor 150, and the actuator 140 can drive the trailing end of the paddle 130 forward along the linear slide to transition the paddle 130 from the retracted setting into the extended setting, and vice versa.

Furthermore, because the paddle 130 may contact hamburgers (or other foodstuffs) output by the automated foodstuff assembly apparatus directly as the conveyor 150 advances the hamburgers into the bag dispenser 120, the paddle 130 can be of a food-safe material base material, such as stainless steel, and/or include a food-safe coating, such as Teflon.

The actuator 140 can include any one or more pneumatic, electromechanical, hydraulic, or other suitable type of linear or rotational actuator. The system 100 can also incorporate one or more limits switches or other sensors that output signals corresponding to a position of the actuator 140 and/or a position of the paddle 130, and the system 100 can implement closed loop feedback to control the actuator 140.

The paddle 130 and the actuator 140 can therefore cooperate to execute Block S120 of the method S100, which recites separating an upper layer of the bag from a lower layer of the bag across the mouth of the bag in Block S120, the lower layer of the bag constrained in to the bag dispenser 120. In particular, the actuator 140 can execute Block S120 to extend a leading edge of the paddle 130 into the mouth of the bag, thereby separating a free lip of the bag from a retained lip of the bag proximal the open side of the bag.

6. Bag Opener Variations

Figure 12:
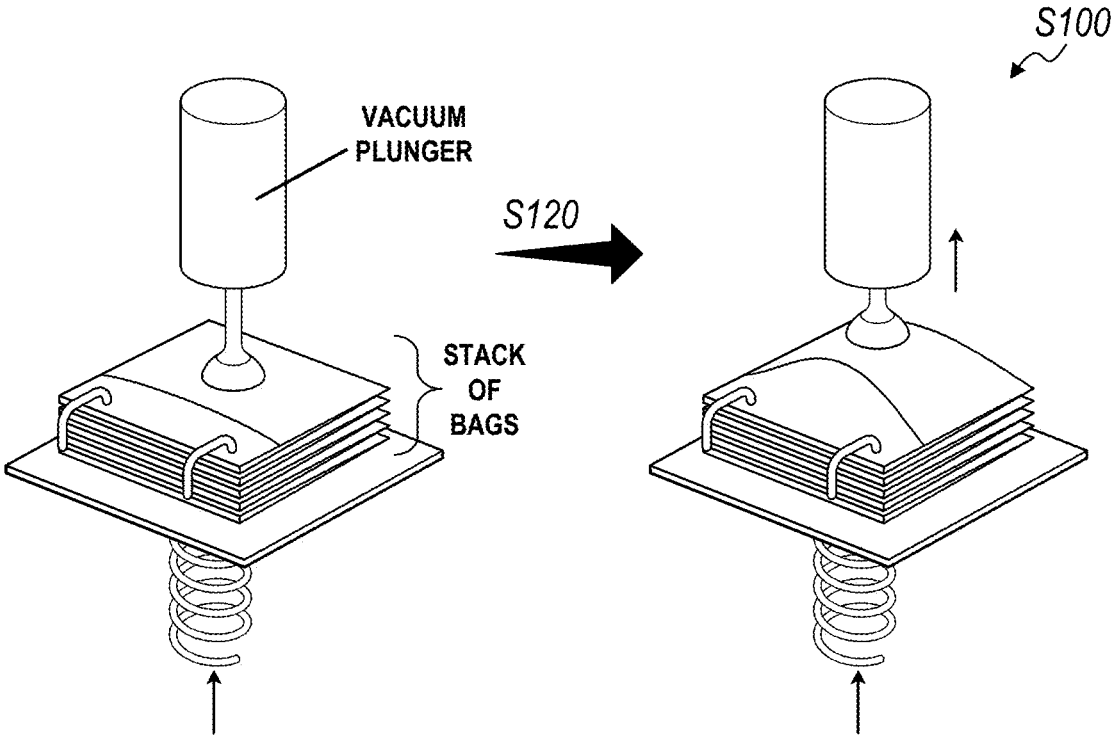
FIG. 12 is a flowchart representation in accordance with one variation of the system and the method.

In one variation of the system 100, as shown in FIG. 12, the system 100 executes Block S120 by driving a plunger 170 toward an exposed surface of a bag in the load position, drawing a vacuum through the plunger 170, and then retracting the plunger 170 to open the bag. In this variation, the system 100 can maintain the vacuum on the plunger 170 to retain the mouth of the bag open until the conveyor 150 loads a hamburger into the bag, as in Block S130. Alternatively, the system 100 can release the vacuum on the bag and retract the plunger 170 once the bag is opened; the conveyor 150 can then advance the hamburger into the opened bag.

In another variation shown in FIG. 13, the system 100 includes a nozzle 127 coupled to an air supply via a valve and arranged adjacent the bag dispenser 120 facing the mouth of a bag in the load position. In this variation, the system 100 can trigger the valve to release a blast of air through the nozzle 127 and toward the mouth of the bag, thereby opening the bag in Block S120. The system 100 can also control a duration of time that the valve is opened, a supply pressure to the nozzle 127, and/or a volume of air released toward the mouth of the bag, such as to substantially ensure that the bag is fully opened but not torn by the blast of air. For example, the nozzle 127 can be adjacent and vertically aligned with a plane of the mouth of a bag in the load position, and the nozzle 127 can distribute the blast of air substantially laterally along the mouth of the bag.

In a similar variation, each of the one or more pins aligning all or a subset of bags in the bag dispenser 120 can be hollow and feature a nozzle 127 along its length that intersects an internal volume of a bag—between the top and bottom layers of the bag—in the load position. Thus, in this implementation, the system 100 can trigger a valve coupled to the pin(s) to release a blast of air through the nozzles in the pins to expand (and to therefore open) the bag, as in Block S120. As in the foregoing variation, the system 100 can also control a duration of time that the valve is opened, a volume of air dispensed through the nozzles, etc. to substantially fully open but not tear the bag in the load position.

In another variation, the system 100 includes a friction roller, and the system 100 drives the friction roller across the exposed outer surface of a bag in the load position, in Block S120, to wrinkle the bag, thereby lifting an exposed layer of the bag, such as around the mouth of the bag. In a similar variation, the system 100 includes a rotating brush with an axis substantially parallel to the length of the mouth of the bag, and the system 100 selectively actuates an actuator coupled to the rotating brush such that the brush contacts, catches on, and pulls a free lip of the bag in the load position, thereby opening the mouth of the bag.

Figure 14:
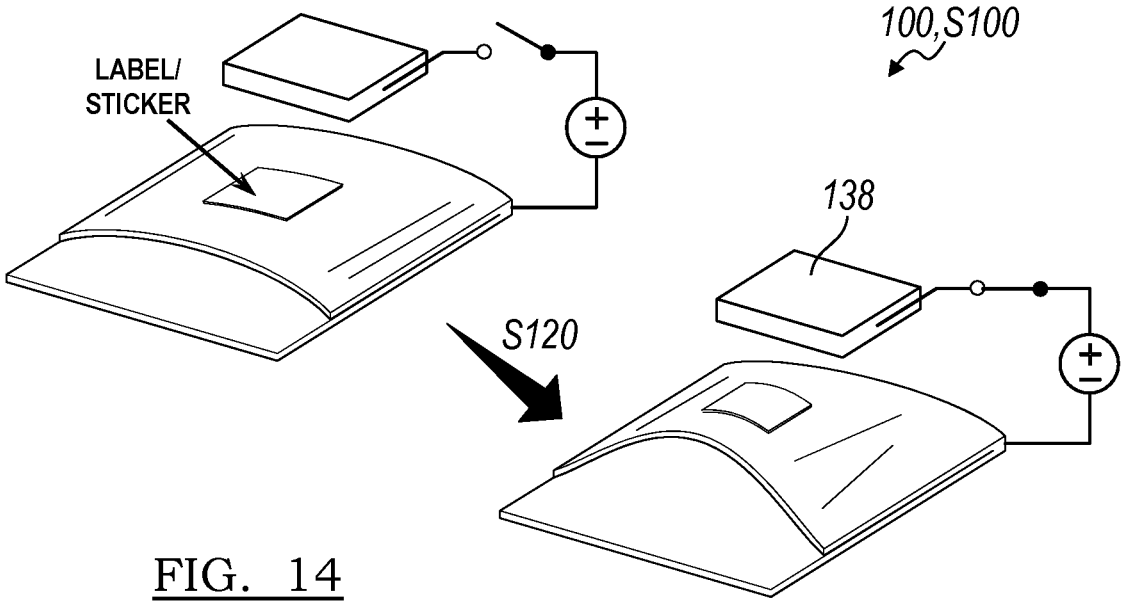
FIG. 14 is a flowchart representation in accordance with one variation of the system and the method.

In yet another variation, as shown in FIG. 14, the system 100 includes an electrode 138 adjacent the load position of the bag dispenser 120, and the system 100 induces an electric field over the exposed outer surface of a bag in the load position, Block S120, to open the bag. In this variation, the bag dispenser 120 can be configured to receive and dispense bags incorporating conductor elements. Alternatively, the system 100 (e.g., the bag dispenser 120) can incorporate an applicator for applying conductor elements to bags in the load position, such as conductor elements in the form of aluminum-faced stickers. The bag dispenser 120 can thus electrostatically charge the conductor element arranged on a bag (or an exposed surface of a bag directly) in the load position; the system 100 can thus execute Block S120 by applying (or adjusting) a voltage applied to the electrode 138 arranged over (or under) the load position of the bag dispenser 120 to draw the bag to open electrostatically. In one example, the system 100 controls an actuator to move an electrostatically-charged brush the exposed surface of the bag to deposit electrons onto the exposed surface of the bag, and the system 100 then applies a positive voltage to the electrode 138 arranged over the bag; the exposed surface of the bag is thus attracted to the electrode 138 and is drawn toward the electrode 138, thereby opening the bag. In a similar example, a lip, roller, or static brush contacts the conductive element arranged on or within the bag once the bag is dispensed into the load position, and the system 100 executes Block S120 to apply a voltage potential across the conductive element (via the lip, roller, or static brush) and the electrode 138 to induce an attractive force between the exposed surface of the bag and the electrode 138, thereby causing the bag to open.

In the foregoing implementation, the bag dispenser 120 can thus be loaded with custom bags, each custom bag featuring a conductive element. For example, the bag dispenser 120 can be configured to receive a custom bag including an aluminum strip arranged on or within a top layer of the bag, such as along a free lip of the mouth of the bag.

Alternatively, the system 100 can apply the conductive element to the bag, such as before the bag is dispensed from the bag dispenser 120. Therefore in one variation, the system 100 can execute Block S112 of the method S100, which recites applying a sticker to the bag. In this variation, the system 100 can apply a metalized or conductive sticker to the bag once the bag is dispensed into the load position in Block S112, and the system 100 can subsequently induce an electric field between the sticker and the electrode 138 to open the bag in Block S120. In this variation, the system 100 can also print customized stickers for each bag, such as based on a patron's name and/or a customer order number associated with a hamburger designated for a particular bag. In particular, the system 100 can print customized stickers including a restaurant name, a customer or group name, a customer or order number, order details (e.g., hamburger topping, condiment, meat, doneness, bun toast, etc.), nutritional information for the hamburger (e.g., for a customized hamburger order), a QR code or barcode, an image, a time, an order cost, etc. For example, the system 100 can print a recipe for the corresponding hamburger and/or a barcode or QR code linked to the recipe for the hamburger corresponding to a bag currently in the load position to provide a final customer of the hamburger with receipt of the hamburger recipe, such as for quick reordering and/or modification at a later date. Once printed, the system 100 can apply the sticker to an available (i.e., exposed) surface of the bag in the load position, such as by applying the adhesive-backed sticker face down onto a roller and then advancing the roller across an exposed surface of the bag, thereby applying the sticker to the bag. For example, the system 100 can apply an adhesive-backed sticker to the exposed surface of the bag with a portion of the sticker hanging off an edge of the bag—such as across the mouth of the bag; the sticker can be subsequently wrapped around the bag, such as automatically or manually, to close the bag once a hamburger is loaded thereinto.

In the foregoing variation, the system 100 can print a logo, product information, or other details general and/or specific to the hamburger onto a sticker before applying the sticker to the bag. Alternatively, the system 100 can print any one or more of order details, customer information, and/or other hamburger-related data directly onto a bag substantially in real-time as the bag is loaded into the load position, such as by applying a food-safe ink onto a roller and then passing the roller across the exposed surface of the bag. In one example, in Block S112, the system 100 interfaces with an ink applicator to spray food-safe ink onto the exposed surface of the bag. In this example, the system 100 can apply a conductive ink on the bag in Block S112, and the system 100 can then charge a conductor arranged over (or under) the bag—once dry the ink—to open the bag, similar to one variation of Block S120 described above. The system 100 can alternatively induce an Eddy current within the ink to attract the exposed surface of the bag toward the electrode 138, thus opening the bag, as described above. Yet alternatively, in this example, the ink can be electrostatically charged prior to or during application of the ink onto the exposed surface of the bag, and the system 100 can manipulate electrically charge the electrode 138, as described above in Block S120, to draw the bag open.

The system 100 can print ink containing ferrous or magnetic particulate onto the bag or onto the sticker applied to the bag, and the system 100 can drive an electromagnet (e.g., rather than an electrode 138) adjacent (e.g., over) the load position of the bag dispenser 120 to attract the ferrous or magnetic particulate, thereby opening the bag in Blocks 120. The system 100 can alternatively apply a sticker or label containing a ferrous insert onto an exposed surface of a bag in the load position and similarly drive an electromagnet adjacent the bag, thereby opening the bag as described above. Similarly, the bag dispenser 120 can be configured to dispense a bag containing ferrous or magnetic insert embedded in one side or layer of the bag, such as in the top layer of the bag along the mouth of the bag, and the system 100 can drive the electromagnet adjacent the bag to attract the insert, thereby opening the bag.

However, the system 100 can execute Block S112 to apply a sticker—such as including any suitable preprinted information and/or custom, hamburger-specific information—onto the bag in any other suitable way, and the system 100 can execute Block S120 to manipulate the sticker in any other suitable way to open the bag. The system 100 can also execute Block S112 to print or otherwise apply any other hamburger-related information onto the bag, such as for use by a customer to identify his hamburger or contents of his hamburger or by an operator or server to manage hamburgers output from the automated foodstuff assembly apparatus.

The system 100 can also implement any combination of the foregoing methods and techniques to open the bag. For example, the system 100 can charge an electrode 138 arranged over the load position to induce an electric field over the exposed surface of a bag in the load position, the electric field drawing the mouth of the bag open by a limited distance (e.g., 0.30" to 0.50"); the system 100 can then actuate a valve to send a blast of air through a nozzle 127 facing the mouth of the bag, the blast of air thus opening the bag further to accept a hamburger in Block S130. In another example, the paddle 130 can include a nozzle 127 adjacent its leading edge, and the system 100 can actuate a valve to send a blast of air through the nozzle 127 and into the bag once the leading edge of the paddle 130 is extended into the mouth of the bag. However, the system 100 can execute Block S120 in any other way to open the mouth of a bag in the load position in preparation to receive a hamburger.

7. Conveyor

The system 100 also includes the conveyor 150 aligned with the ramp 110 and the bag dispenser 120, supporting a foodstuff, and advancing the foodstuff toward the bag dispenser 120. Generally, the conveyor 150 functions to advance a sequence of hamburgers (or other foodstuffs) forward toward the bag dispenser 120 for insertion into corresponding bags.

In one variation, the conveyor 150 supports a sequence of hamburgers in various stages of assembly, as described in U.S. patent application Ser. No. 13/911,637. For example, a series of topping dispensation modules and condiment dispensation modules can be arranged over the conveyor 150, a bun dispenser within the automated foodstuff assembly apparatus can sequentially load bun heels onto carriages along the conveyor 150, and the conveyor 150 can index the carriages—now loaded with heel buns—forward along the series of topping dispensation modules and condiment dispensation modules. The automated foodstuff assembly apparatus can then selectively and sequentially trigger the topping dispensation modules and the condiment dispensation modules according to a custom hamburger order assigned to each bun heel loaded into the conveyor 150. Once toppings, condiments, a patty, and a bun crown, etc. specified in a hamburger order are assembled onto a corresponding bun heel, the conveyor 150 can index the completed hamburger forward and into a corresponding bag, such as a bag preprinted with order details and/or a customer's name specific to the hamburger. Once the bag and hamburger are released from a corresponding carriage 152 and onto the chute 160, the conveyor 150 can return the carriage 152 back to an initial position within the automated foodstuff assembly apparatus, such as to receive a fresh bun heel or for cleaning (e.g., by spraying with compressed air) before receiving a fresh bun heel.

For example, the conveyor 150 can thus return a receptacle 152 (e.g., the carriage 152) to an initial position in response to dispensation of the foodstuff and the bag onto the chute 160; and the automated foodstuff assembly apparatus can dispense a first food element (e.g., a heel bun) of a second foodstuff (e.g., hamburger) into the receptacle 152 in the initial position; index the receptacle 152 forward to a second position; and dispense a second food element (e.g., a slice of tomato) of the second foodstuff onto the first food element. Meanwhile, the bag dispenser 120 can dispense a second bag into the load position; and the paddle 130 and the actuator 140 can cooperate to separate an upper layer of the second bag from a lower layer of the second bag across the mouth of the second bag. The conveyor 150 can then advance the receptacle 152 toward the bag dispenser 120 to insert the receptacle 152 and the second foodstuff into the mouth of the second bag and then advance the receptacle 152 further forward once the second foodstuff is substantially fully contained within the second bag, thereby drawing the second bag out of the bag dispenser 120. In this example, the conveyor 150 can advance a foodstuff forward, once inserted fully into a bag in the load position, to tear the bag around a hook 122 retained the bag, thereby drawing the bag out of the bag dispenser 120. The conveyor 150 can additionally or alternatively advance the foodstuff forward, once inserted fully into a bag in the load position, to draw a lower layer of the bag from a lip defined by the bag dispenser 120, as described above, thereby removing the bag from the bag dispenser 120. The conveyor 150 can then release the receptacle 152 from the second foodstuff to deposit the second foodstuff and the second bag onto the chute 160 for delivery to a second customer. The conveyor 150, the bag dispenser 120, the paddle 130, the actuator 140, and/or other systems and subsystems within the automated foodstuff assembly apparatus can repeat this cycle to continually assemble, bag, and dispenser assembled foodstuffs. The conveyor 150 can therefore also incorporate multiple receptacles (or carriages) supporting a sequence of hamburgers in various stages of assembly with a most completed hamburger approaching the bag dispenser 120 and a hamburger in an initial stage furthest from the bag dispenser 120, and the conveyor 150 can index the receptacles forward in unison to align the sequence of hamburgers with corresponding topping dispensers, condiment dispensers, bun crown dispensers, and/or the bag dispenser 120, etc.

7.1 Elevator Subsystem

The conveyor 150 can also include a static or dynamic elevator subsystem 180 that functions to elevate receptacles—supporting hamburgers in various stages of assembly along the conveyor 150—toward the topping dispensation modules and/or toward the condiment dispensation modules. In particular, the elevator subsystem 180 can shift the vertical position of a receptacle 152 toward a condiment or topping dispensation module to reduce a vertical distance between a hamburger supported within the receptacle 152 and an output end of an adjacent topping dispensation module, thereby enabling a relatively high accuracy and repeatability in gravity-feeding toppings from the adjacent topping dispensation module onto hamburgers.

Figure 7:
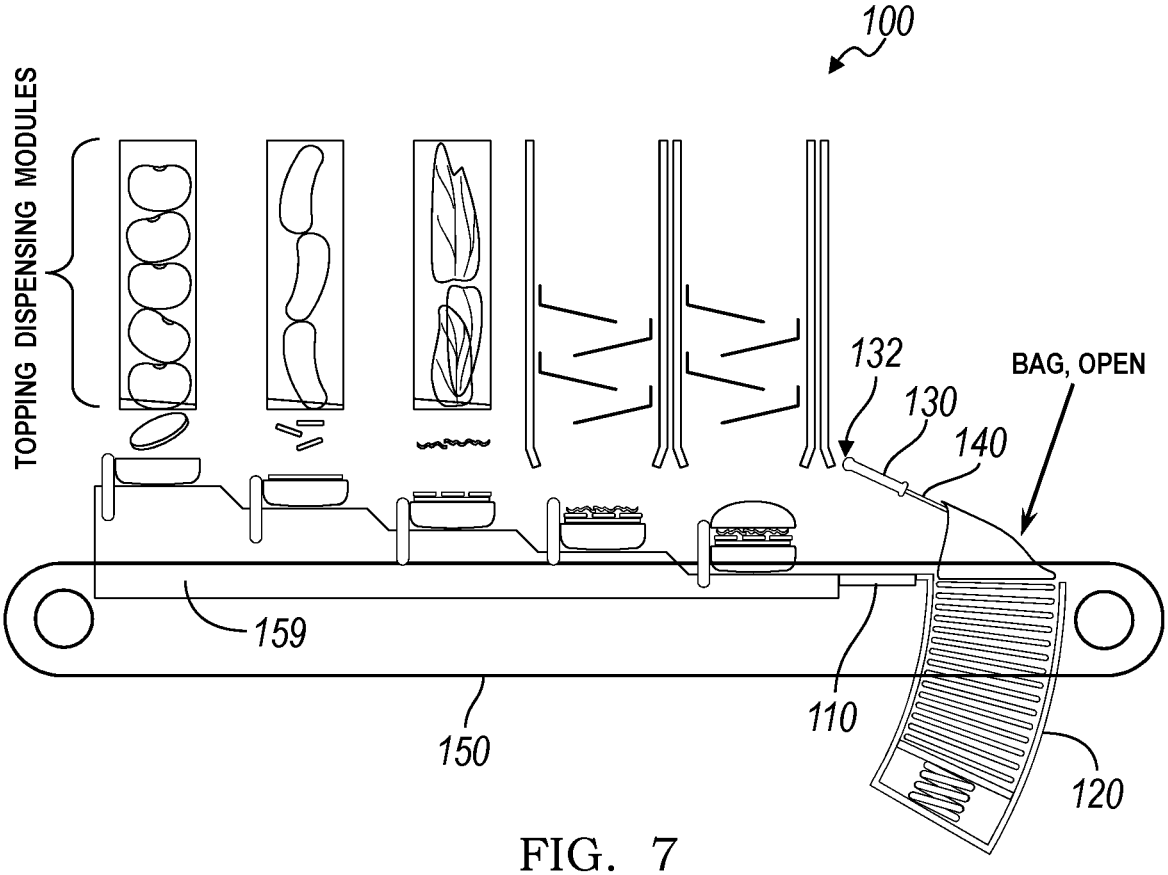
FIG. 7 is a schematic representation in accordance with one variation of the system.

In one example implementation, the conveyor 150 includes a set of carriages (or receptacles) and a stepped track 159 (the elevator subsystem 180) arranged under a series of topping dispensation modules, each carriage 152 configured to support a hamburger bun (loaded with additional toppings, condiments, patties, etc. by subsequent topping dispensation modules) laterally and longitudinally along the stepped track 159, and the stepped track 159 configured to support the hamburger bun vertically, as shown in FIGS. 7 and 8. In this example, implementation, the stepped track 159 can feature a series of steps declined downward from an initial position—in which a bun heel is dispensed from the bun dispenser—to the load position at the bag dispenser 120. The stepped track 159 can define a first step offset below a bun heel dispenser, such as by a distance slightly greater than a maximum thickness of bun heels dispensed from the bun heel dispenser; the conveyor 150 can thus index a receptacle 152 over the first step between the stepped track 159 and the bun heel dispenser, and the bun heel dispenser can dispenser a bun heel into the receptacle 152 to be supported vertically by the stepped track 159 and laterally and longitudinally by the receptacle 152. The conveyor 150 can then advance the receptacle 152 over a second adjacent step offset below a tomato slice dispenser, such as by a distance slightly greater than a maximum possible combined thickness of a bun heel and a tomato slice dispensed from the automated foodstuff assembly apparatus. The conveyor 150 can thus advance the bun heel and a tomato sliced dispensed onto the bun heel—through the offset between the tomato slice dispenser and the second step of the stepped track 159—into position over a third step of the stepped track 159, such as offset below a pickle dispensation module. The stepped track 159 can thus support hamburgers at varying depths below topping dispensation modules arranged over the conveyor 150 to accommodate increasing total heights of hamburgers passing through the automated foodstuff assembly apparatus as the topping dispensation modules dispense toppings in sequence onto the hamburgers (according to corresponding hamburger-specific orders).

In the foregoing example implementation, the stepped track 159 can thus directly provide vertical support to bun heels of hamburgers assembled within the automated foodstuff assembly apparatus, and the stepped track 159 can terminate at the ramp 110 (and/or at the inlet of the bag dispenser 120); the ramp 110 (and/or the bag dispenser 120) can thus provide vertical support to hamburgers loaded into bags dispensed from the bag dispenser 120, and bags filled with hamburgers can then drop onto a chute 160 behind the bag dispenser 120 once extracted from the bag dispenser 120, as in Blocks S140 and S150.

Alternatively, the conveyor 150 can incorporate a series of receptacles, each receptacle 152 including a horizontal base platform configured to support bun heels and coupled to a piston that engages the stepped track 159 (the elevator subsystem 180) arranged therebelow, as shown in FIGS. 7 and 8. For example, the stepped track 159 can define a linear cam, and a piston—extending downward from the horizontal base platform—can define a roller tip that runs along the stepped track 159 to index the horizontal base platform downward as the conveyor 150 indexes the receptacle 152 forward into position under each successive topping dispensation module.

In an alternative example implementation, the conveyor 150 can incorporate a series of independently-controlled actuators (the elevator subsystem 180), each actuator arranged below (or otherwise adjacent) a corresponding topping dispensation module and independently extensible to various offset distances from the corresponding topping dispensation module. In this example implementation, the conveyor 150 can advance a series of receptacles forward to distinct positions under a series of topping dispensation modules within the automated foodstuff assembly apparatus and over the series of actuators. The automated foodstuff assembly apparatus can then selectively adjust a height of each actuator to drive the receptacles toward adjacent topping dispensation modules prior to actuation of the topping dispensation modules to dispense topping servings onto hamburgers (in various stages of assembly) supported in the adjacent receptacles. In particular, the automated foodstuff assembly apparatus can track a position of each hamburger passing through the conveyor 150, control operation of the topping dispensation modules to dispense select toppings onto each hamburger based on topping orders corresponding to each hamburger, and selectively adjust the vertical position of each actuator along the conveyor 150 based on a height of each hamburger overhead the actuator such that a top surface of each hamburger is offset below an adjacent topping dispensation module by a target distance despite which toppings have or have not been previously dispensed onto each hamburger. For example, the automated foodstuff assembly apparatus can interface with an optical sensor (e.g., a camera) a depth gauge, or any other suitable sensor to detect a total height of each hamburger supported on the conveyor 150, such as as the conveyor 150 advances the hamburger forward into positions under subsequent topping dispensation modules (e.g., according to machine vision techniques), and the automated foodstuff assembly apparatus can implement these detected hamburger heights to adjust the heights of the actuators. Alternatively, the automated foodstuff assembly apparatus can track which toppings have thus far been dispensed onto each hamburger loaded into the conveyor 150 and apply a known or average height of bun heels and topping types supported by the automated foodstuff assembly apparatus to estimate a total current height of each hamburger currently within the conveyor 150.

However, the conveyor 150 and/or the automated foodstuff assembly apparatus can incorporate any other suitable elevator subsystem 180, actuator, passive component, or active component to set a height of a hamburger loaded into the conveyor 150 below an adjacent topping dispensation module in preparation for dispensation of a corresponding topping serving onto the hamburger.

7.2 Carriage/Receptacle

As described above, the conveyor 150 can also include one or more carriages that engage hamburgers to provide lateral and/or longitudinal support to the hamburgers as the hamburgers are advanced toward the bag dispenser 120.

Figure 15:
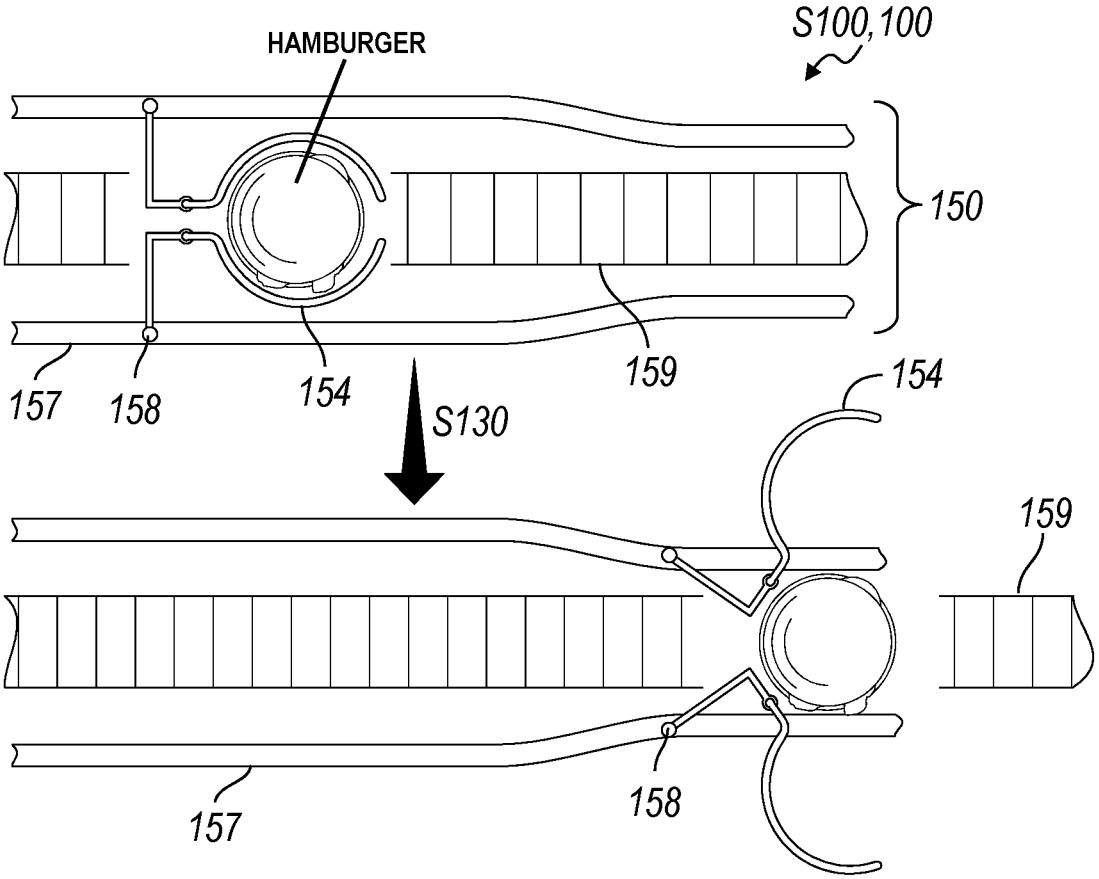
FIG. 15 is a flowchart representation in accordance with one variation of the system and the method.

As shown in FIG. 15, each carriage 152 can include a set (e.g., two) of fingers encircling a portion of a perimeter of the foodstuff, the fingers restraining the hamburger laterally and longitudinally, and the ramp 110 (or other elevator subsystem 180) providing vertical support to the hamburger. Generally, the set of fingers 154 can function to guide dispensation of condiments, patties, bun crowns, etc. onto the bun heel, to support the hamburger bun (and eventually the completed hamburger) during assembly, and to move the hamburger bun (etc.) forward toward the bag dispenser 120, such as along the stepped track 159. In one example implementation, each finger in the set of fingers 154 is substantially semi-circular in profile with a common center approximately intersecting a target center of a round hamburger bun dispensed into the carriage 152, as shown in FIG. 15. The set of fingers 154 can also encircle a portion of a perimeter of the hamburger in a first configuration to support the hamburger laterally during insertion of the hamburger into the bag, and the set of fingers 154 can (actively or passively) expand outwardly into a second configuration to release the hamburger and the bag, such as in response to advancement of the set of fingers 154 passed the bag dispenser 120 in Block S150. For example, each finger can be sprung and/or can be of a flexible material to enable the finger to deflect away from and thus release a hamburger when the hamburger and bag are dispensed from the conveyor 150, such as onto the chute 160 in Block S150. Alternatively, the conveyor 150 can include one or more linear cams along its length, and each finger in the set of fingers 154 can define a cam follower 158 that engages and follows a corresponding linear cam, as shown in FIG. 15. In this example, each linear cam 157 can maintain a corresponding finger in a closed position around the hamburger throughout various stages of assembly of the hamburger, and the linear cam 157 can subsequently cause the finger to open, thereby releasing the hamburger and the bag onto the chute 160 for delivery to a customer once the hamburger is fully inserted into a bag (as in Block S140) and the bag ripped from the bag dispenser 120 (as in Block S150).

Figure 16:
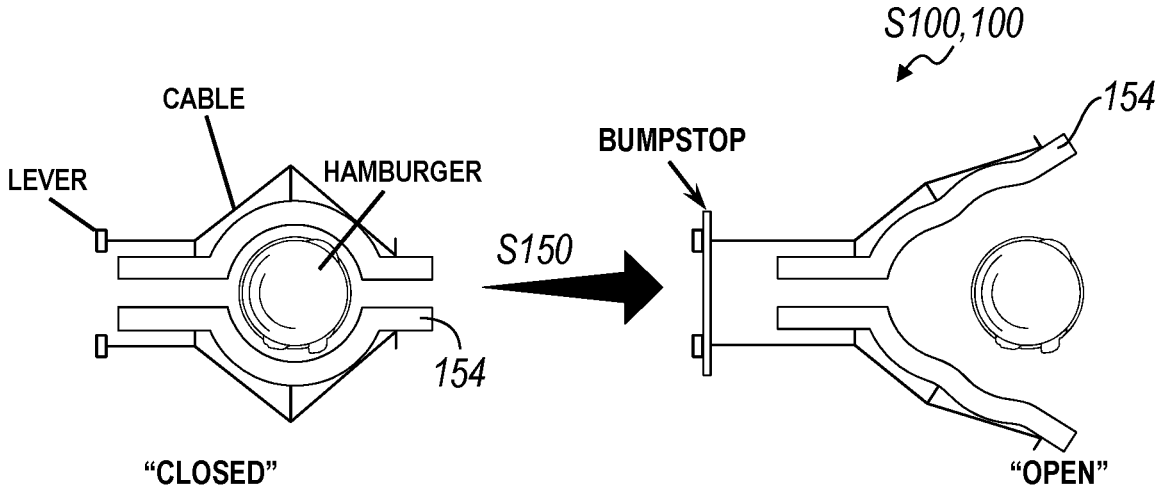
FIG. 16 is a flowchart representation in accordance with one variation of the system and the method.

In yet another example, each finger in the set of fingers 154 is flexible and closes around the hamburger in a default configuration, and the corresponding carriage 152 further includes a cable arranged over the outside of each finger, as shown in FIG. 16. In this example, a lever coupled to the cables contacts a bumpstop near the end of the conveyor 150 to tension the cables, the cables thus opening the fingers to release the hamburger and bag. Furthermore, in this example, once the hamburger and bag are released and the lever passes the bumpstop, the level can pass the bump stop to release tension on the cables, and the fingers can thus return to their default closed position ready to accept a new bun once returned to the front of the automated foodstuff assembly apparatus.

In another example, the paddle 130 can define one or more cams along its length, and each finger can include a follower that engages the cams on the paddle 130 to expand the fingers as the hamburger is driven into a bag and passed the bag dispenser 120 by the conveyor 150; once opened, the fingers can thus release the bag and the inserted hamburger. In this example (and in other implementations of the system 100), the paddle 130 can feature vertical fins that extend downward (or upward) along its length to provide additional lateral support to a hamburger during insertion of the hamburger into the bag. In this example, fins extending from the paddle 130 can further define linear cams directly or indirectly engaged by the fingers to transition the fingers from a closed configuration into an open configuration as a hamburger is shifted along the paddle 130 by the conveyor 150. Alternatively, the carriage 152 (exclusive of fingers described above) can contact a rear side of the hamburger to push the hamburger forward into the bag dispenser 120, and the fins extending from the paddle 130 can act directly on the hamburger to provide lateral support to the hamburger as the hamburger is inserted into a bag in the load position. However, one or more fingers suspended off of a carriage 152 within the conveyor 150 can be passively or actively transitioned from a closed configuration into an open configuration in any other way to release a hamburger and a bag from the conveyor 150, as in Block S150.

Figure 17A:
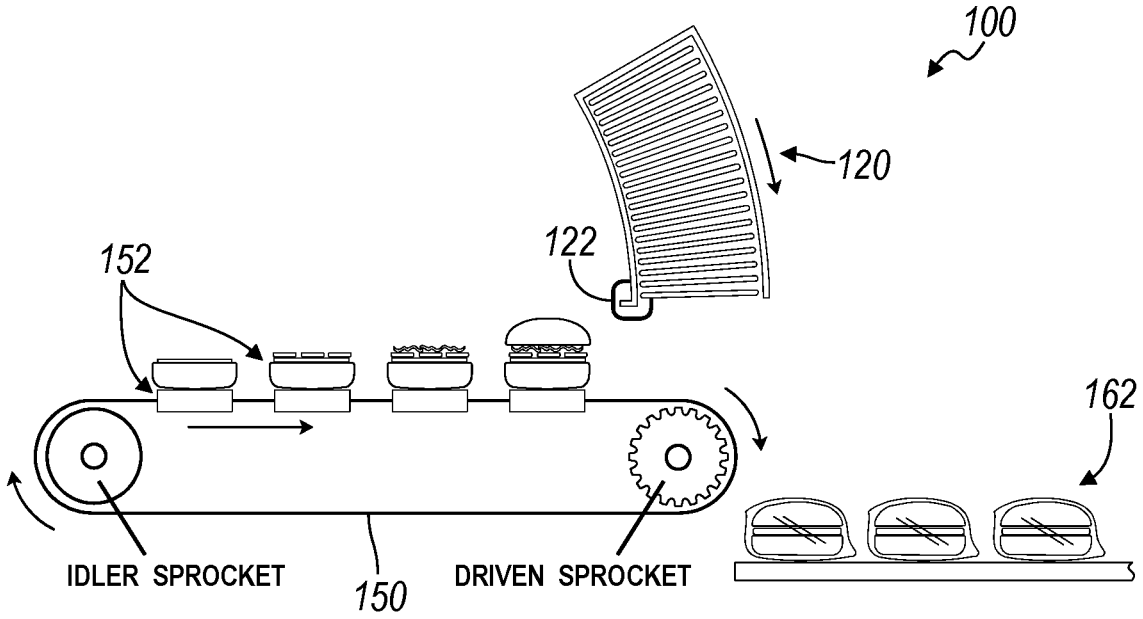
FIGS. 17A and 17B are a schematic representation in accordance with variations of the system.
Figure 17B:
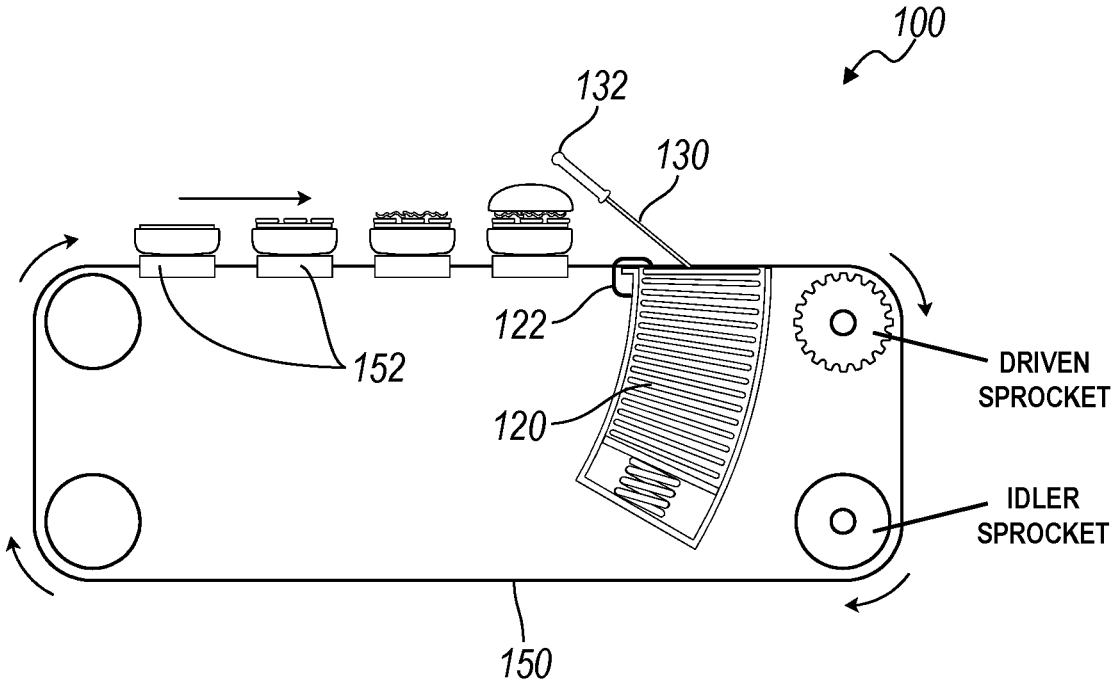

The conveyor 150 can include a (continuous) chain, cable, tread, or other continuous drive mechanism suspended across one or more idler sprockets and one or more driven sprockets, as shown in FIGS. 17A and 17B. The conveyor 150 can also include one or more actuators—such as a rotary electric, pneumatic, or hydraulic motor—coupled to and driving the driven sprocket(s) to shift carriages (i.e., receptacles) along various positions within the automated foodstuff assembly apparatus. A carriage 152 within the conveyor 150 can also feature latches 153 (as shown in FIG. 10)—such as driven by electromechanical solenoids—that selectively engage the continuous drive mechanism (or vice versa) to selectively couple and decouple the carriage 152 from the continuous drive mechanism.

7.3 Orientations

In one implementation, the bag dispenser 120 is arranged within the conveyor 150, the paddle 130 in including downward toward the bag dispensers, and the conveyor 150 drives the foodstuff into the paddle 130, thereby causing the paddle 130 to pivot and the leading edge of the paddle 130 to shift increasingly upward as the foodstuff is driven into the paddle 130. The leading edge of the paddle 130—previously displaced into the mouth of the a bag in the load position—thus elevates by a sufficient distance to enable the foodstuff to pass between the bottom surface of the paddle 130 and the top of the ramp 110, the top of the lip, and/or the lower layer of the bag; the lip, hook 122, and/or other feature within the bag dispenser 120 retains the bottom layer of the bag; and the conveyor 150 forces the foodstuff into the mouth of the bag. The bag dispenser 120 can retain the bag with sufficient force to prevent ejection of the bag from the load position until the foodstuff is fully inserted into the bag, and the conveyor 150 can continue to advance the foodstuff forward once fully inserted into the bag to rip, tear, or otherwise eject the bag from the bag dispenser 120.

In the foregoing implementation, the carriage 152 (or the fingers connected thereto) supporting the foodstuff can alternatively contact the paddle 130 to pivot the paddle 130 about the hinge to thus open a bag. Yet alternatively, the carriage 152 (or the fingers connected thereto) supporting the foodstuff can make initial contact with the paddle 130 to pivot the paddle 130 about the hinge, and the foodstuff (e.g., the bun crown of a hamburger) can make subsequent contact with the paddle 130 to further pivot the paddle 130 to open the bag.

In an alternative implementation, the ramp 110 is arranged over the conveyor 150, the bag dispenser 120 is arranged over the conveyor 150 and dispenses bags downward into the load position over the conveyor 150; and the paddle 130 is sprung upward toward a bag in the load position by a spring. In this implementation, once the paddle 130 is extended into the mouth of a bag in the load position, the carriage 152, a finger extending from the carriage 152, and/or a foodstuff supported within the carriage 152 can contact the paddle 130 and act against the spring to lower the leading edge of the paddle 130, thereby further opening the bag as the foodstuff is advanced through the bag dispenser 120 by the conveyor 150.

However, the conveyor 150 can incorporate any other suitable component or subsystem, can be oriented relative to other systems within the automated foodstuff assembly apparatus in any other way, and can function in any other way to support a hamburger bun (and eventually a completed hamburger) throughout operation of the automated foodstuff assembly apparatus and throughout execution of the method S100.

8. Chute

One variation of the system 100 further includes a chute 160 and a plunger 170, the chute 160 aligned longitudinally with the conveyor 150 and adjacent the bag dispenser 120 opposite the ramp 110, and the plunger 170 arranged over the chute 160. In this variation, the conveyor 150 can advance the foodstuff and the bag over the chute 160, and the plunger 170 can extend downward toward the chute 160 to thrust the foodstuff and the bag from the conveyor 150 onto the chute 160. For example, the plunger 170 can include a platter coupled to a linear actuator, such as a pneumatic ram, and the system 100 can trigger the linear actuator to drive the platter downward toward chute 160 to drive a bagged hamburger off of the conveyor 150 and onto the chute 160.

Figure 18:
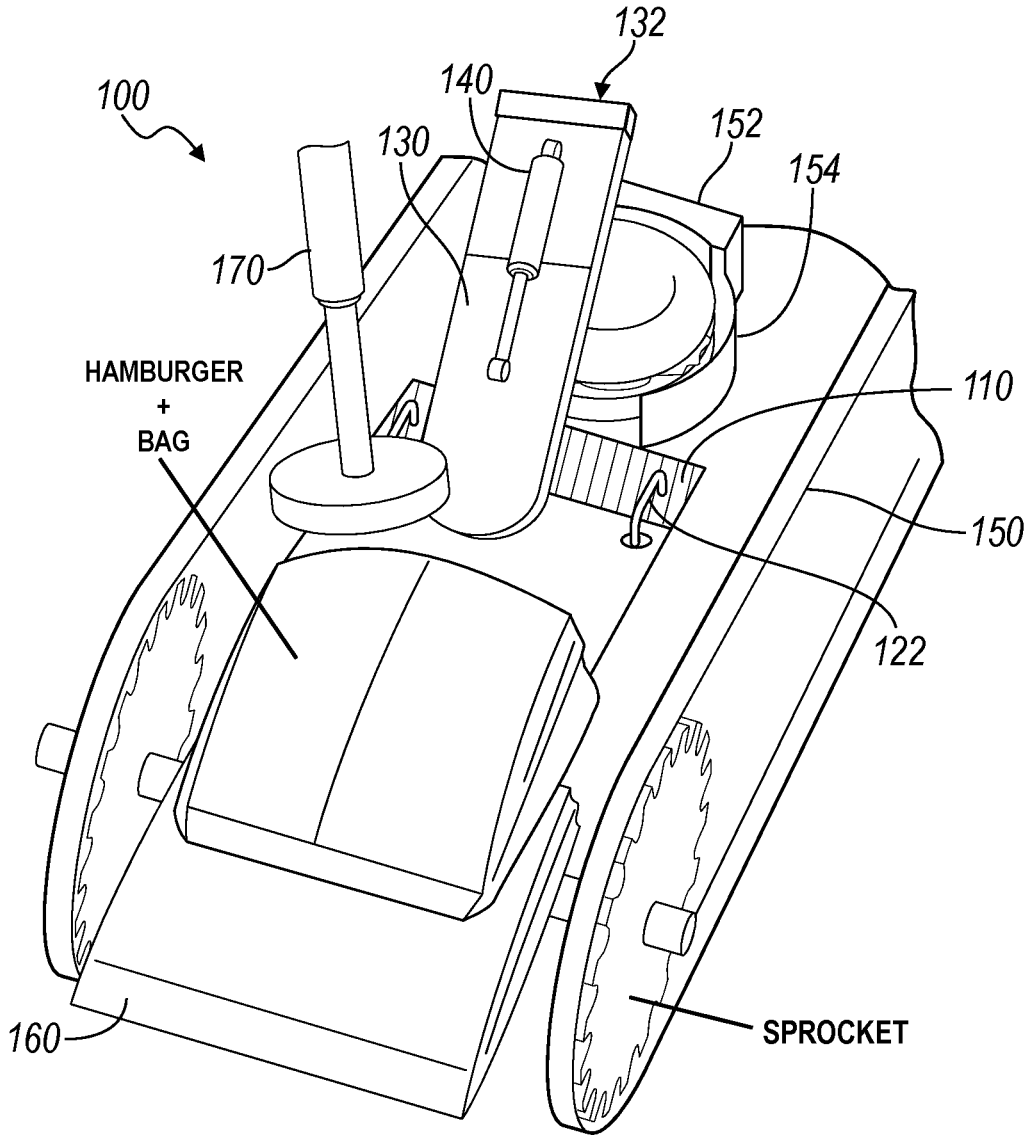
FIG. 18 is a schematic representation in accordance with one variation of the system.

As shown in FIG. 18, the chute 160 can direct a bagged hamburger into a trough containing completed and bagged hamburgers awaiting delivery to customers. For example, Block S150 can release the bagged hamburger—from the set of fingers 154—onto the chute 160, and the chute 160 can be hinged such that the chute 160 pivots downward when contacted by the conveyor 150, the chute 160 thus releasing the bagged hamburger downward and into the trough for collection by an operator or by a customer.

9. Process

The conveyor 150 (and other subsystems within the automated foodstuff assembly apparatus) can therefore execute: Block S110 of the method S100, which recites constraining the foodstuff within the receptacle 152; Block S130 of the method S100, which recites advancing the receptacle 152 into the first position to insert the receptacle 152 and the foodstuff into the mouth of the bag; Block S140 of the method S100, which recites advancing the conveyor 150 to insert the hamburger into the bag, the conveyor 150 supporting the hamburger in alignment with the bag; and Block S150 of the method S100, which recites releasing the receptacle 152 from the foodstuff to deposit the foodstuff and the bag onto the chute 160 for delivery to the customer in Block S150. Generally, the conveyor 150 executes Blocks S110, S130, S140, and S140 to move hamburgers through assembly, bagging, and dispensing stages within the automated foodstuff assembly apparatus.

In one implementation, the conveyor 150 executes Block S150 by continuing advancement of a carriage 152 forward passed the bag dispenser 120, and a cam, bumpstop, or other feature within the conveyor 150 triggers a set of fingers 154—coupled to a carriage 152 and arranged about a hamburger—to release the hamburger, as described above. As the conveyor 150 continues to advance the carriage 152 forward, the bagged hamburger progresses over a curved track, and a sprocket supporting the continuous drive mechanism of the conveyor 150 rotates the carriage 152 arcuately downward before returning the carriage 152 back to the front of the automated foodstuff assembly apparatus. As the carriage 152 rotates downward, the bagged hamburger is thus released from the carriage 152 and dispensed onto the chute 160 outside of the conveyor 150, such as via a curved track.

In another implementation, once the conveyor 150 tears the bag from the bag dispenser 120 in Block S140, system drives a plunger 170 (shown in FIG. 18) downward onto the bagged hamburger, thereby constraining the bagged hamburger, and the conveyor 150 retracts the conveyor 150 to draw a set of fingers 154 out of the bag, the bagged hamburger thus dropping onto the chute 160 below in Block S150. The conveyor 150 can then advance the carriage 152 forward to push the bagged hamburger down the chute 160 for delivery to a customer.

In yet another implementation, each finger in a set of fingers 154 extending from the carriage 152 can be curved (e.g., semi-circular) and flexible, define an internal passage, and include a nozzle at a far end. In this implementation, once the conveyor 150 tears the bag from the bag dispenser 120, the system 100 can actuates a valve to drive a blast of air through the internal passages within the fingers and out through their corresponding nozzles, thereby causing the fingers to straighten momentarily, raising air pressure inside the bag, and forcing the hamburger and bag off of the set of fingers 154. The bagged hamburger can thus be deposited onto the chute 160 in Block S150, or the conveyor 150 can continue to advance the carriage 152 forward to push the bagged hamburger onto the chute 160.

However, the conveyor 150 and/or other systems and subsystems of the automated foodstuff assembly apparatus can execute Blocks of the method S100 in any other way to bag and then release a hamburger from the automated foodstuff assembly apparatus for delivery to a customer.

10. Discarded Bag

In one variation of the system 100, the paddle 130 is further operable in a discard setting, and the actuator transitions the paddle 130 into the discard setting in response to detection of misalignment of a bag in the load position in the bag dispenser 120 in order to remove the misaligned bag from the bag dispenser 120. In this variation, the system 100 can thus execute Block S160 of one variation of the method S100, which recites detecting misalignment of a bag in the load position in the bag dispenser 120 and extending the leading edge of the paddle 130 passed the extended setting into a discard setting to discard the second bag from the bag dispenser 120, as shown in FIG. 19.

In one implementation, the system 100 interfaces with an optical sensor (e.g., a camera) arranged over the system 100 and implements machine vision and/or machine learning techniques to detect a bag improperly dispensed into the load position or a bag otherwise unfit for delivery to a customer. For example, the system 100 can implement machine vision to detect a torn bag, a crooked bag, a stained or soiled bag, a folded bag, a bag not properly constrained by one or more pins, rollers, or lips within the bag dispenser 120, a bag with misplaced application of a sticker, label, or printed text, etc. in Block S160 The system 100 can alternatively interface with any other suitable sensor to detect a misplaced or unfit bag in the load position.

Once the system 100 identifies an unfit or improperly-loaded bag in Block S160, the system 100 can trigger a subsystem within the automated foodstuff assembly apparatus to dispose of the bag prior to loading with a completed hamburger. For example, in the implementation described above in which the paddle 130 is extensible, the system 100 can trigger the actuator to extend the paddle 130 to a third extended length that causes the paddle 130 to tear the misaligned bag from the bag dispenser 120 and to drop the bag into a discard container. In another example, the system 100 advances a set of rollers onto the bag and then drives (i.e., rotates) the rollers to rip the bag from the bag dispenser 120. The system 100 can then repeat Block S110 to dispense a fresh bag into the load position.

However, the system 100 can implement any technique to identify a misplaced or unfit bag and can control and/or interface with any other actuator or disposal subsystem with the automated foodstuff assembly apparatus to remove the misaligned or unfit bag from the bag dispenser 120.

11. Discarded Foodstuff

The system 100 can further interface with one or more sensors within the automated foodstuff assembly apparatus to detect dislocation (e.g., dislodgement) of contents of a hamburger before or during insertion of the hamburger into a bag, and the system 100 can discard the hamburger and the bag accordingly. The system 100 can then restore an order for the discarded hamburger to an assembly queue to remake the hamburger. In one example, the system 100 collects digital photographic images of hamburgers as the hamburgers are assembled along the conveyor 150 and implements machine vision techniques to detect disheveled hamburgers and/or hamburgers improperly loaded into corresponding bags from these digital photographic images. In particular, the system 100 can identify a hamburger that is unfit for delivery to a customer, such as a hamburger that is toppling over or disheveled, and the system 100 can actively discard the hamburger before delivery to a customer. In one example, the system 100 triggers a gate arranged within the chute 160 or within the trough described above to direct a disheveled or otherwise unfit hamburger into a trash collector. In this example, the system 100 can then reset an order for the disposed hamburger into a hamburger queue such that a replacement for the disposed hamburger can be made and bagged properly for delivery to the corresponding customer.

However, the system 100 can function in any other way to detect an improper or unfit hamburger and to dispose of the hamburger accordingly.

The method S100 and system of the embodiments can be embodied and/or implemented at least in part as a machine configured to receive a computer-readable medium storing computer-readable instructions. The instructions can be executed by computer-executable components integrated with an application, applet, host, server, network, website, communication service, communication interface, hardware/firmware/software elements of a user computer or mobile device, or any suitable combination thereof. Other systems and methods of the embodiments can be embodied and/or implemented at least in part as a machine configured to receive a computer-readable medium storing computer-readable instructions. The instructions can be executed by computer-executable components integrated by computer-executable components integrated with apparatuses and networks of the type described above. The computer-readable medium can be stored on any suitable computer readable media such as RAMs, ROMs, flash memory, EEPROMs, optical devices (CD or DVD), hard drives, floppy drives, or any suitable device. The computer-executable component can be a processor but any suitable dedicated hardware device can (alternatively or additionally) execute the instructions.

What is claimed is:

1. A system for packing a foodstuff, the system comprising:

a conveyor including a carriage transporting the foodstuff along a path of movement;

a bag dispenser containing a plurality of bags and moving a first bag of the plurality of bags into the path of movement; and a paddle including a hinge and an actuator, wherein:

the hinge is disposed at a trailing edge of the paddle and above the path of movement, the actuator moves a leading edge of the paddle relative to the trailing edge between a retracted position in which the leading edge is disposed at a first distance from the trailing edge and an extended position in which the leading edge is disposed at a second distance from the trailing edge, the second distance is greater than the first distance, the leading edge of the paddle moves into a mouth of the first bag as the leading edge is moved from the retracted position to the extended position, and while the paddle is in the extended position, movement of the carriage and the foodstuff along a portion of the path of movement underneath the paddle rotates the leading edge of the paddle about the hinge to open the mouth of the first bag such that continued movement of the carriage and the foodstuff along the path of movement moves the foodstuff through the mouth and into the first bag.

2. The system of claim 1, wherein:

the bag dispenser comprises a hook passing through the plurality of bags, and once the foodstuff is fully inserted into the first bag, continued movement of the carriage and the foodstuff along the path of movement tears the first bag off of the hook.

3. The system of claim 1, further comprising a ramp disposed along the path of movement, wherein the carriage moves the foodstuff along the ramp before the foodstuff is inserted into the first bag.

4. The system of claim 3, wherein:

the bag dispenser comprises a lip extending from the ramp toward the first bag, the lip retaining a lower layer of the first bag along the mouth of the first bag, and the leading edge of the paddle moves along the ramp, over the lip, and into the mouth of the first bag as the leading edge moves from the retracted position to the extended position.

5. The system of claim 1, wherein:

the bag dispenser comprises a gear rack, a pinion, and a platen, the gear rack is arranged below the path of movement, the pinion runs in the gear rack, the platen extends from the pinion, the platen supports the plurality of bags in a stack, and to advance the plurality of bags toward the path of movement, the pinion translates linearly along the gear rack, rotating the platen toward the path of movement.

6. The system of claim 5, wherein:

the bag dispenser comprises a spring coupled to the platen, and the spring advances the pinion upward along the gear rack.

7. The system of claim 1, wherein:

the carriage comprises a set of fingers encircling a portion of a perimeter of the foodstuff, the conveyor advances the carriage and the foodstuff toward the first bag and inserts the set of fingers and the foodstuff into the mouth of the first bag, and the set of fingers releases the foodstuff in response to extraction of the first bag from the bag dispenser.

8. The system of claim 7, wherein:

the set of fingers encircles the portion of the perimeter of the foodstuff in a first configuration to support the foodstuff laterally during insertion of the foodstuff into the first bag, and in response to the set of fingers advancing past the bag dispenser, the set of fingers expands outwardly into a second configuration to release the foodstuff and the first bag.

9. The system of claim 1, further comprising:

a chute with a first end disposed along the path of movement, wherein the carriage forces the foodstuff and the first bag into the first end of the chute after the foodstuff is fully inserted into the first bag.

10. The system of claim 9, further comprising:

a plunger arranged vertically above the chute, wherein the plunger is movable downward toward the chute to force the foodstuff and the first bag onto the chute after removal of the first bag from the bag dispenser.

11. The system of claim 1, wherein the actuator is configured to, in response to detection of misalignment of a second bag from the bag dispenser with the path of movement, move the paddle into a discard setting.

12. The system of claim 1, wherein:

the conveyor includes a pair of chains moveable in respective parallel loops, the carriage extends between the chains and removably engages the chains, and the path of movement of the foodstuff is disposed between the chains.

13. The system of claim 12, wherein the bag dispenser is disposed between the chains.

14. The system of claim 13, wherein a portion of the carriage extends underneath the foodstuff to vertically support the foodstuff between the chains.

15. A system for packing a foodstuff, the system comprising:

a conveyor including a continuous drive mechanism and a carriage transporting the foodstuff along a path of movement;

a bag dispenser containing a plurality of bags and moving a first bag of the plurality of bags into the path of movement; and a bag opener moving an upper layer of the first bag relative to a lower layer of the first bag to open a mouth of the first bag, wherein while the mouth of the first bag is open, movement of the carriage and the foodstuff along the path of movement moves the foodstuff and at least a portion of the carriage through the mouth and into the first bag, wherein continued movement of the carriage and the foodstuff while the portion of the carriage and the foodstuff are inside of the first bag removes the first bag from the bag dispenser, and wherein the system is operable to selectively couple and decouple the carriage from the continuous drive mechanism during operation of the system.

16. The system of claim 15, wherein:

the bag dispenser comprises a hook passing through the plurality of bags, and once the foodstuff is fully inserted into the first bag, continued movement of the carriage and the foodstuff along the path of movement tears the first bag off of the hook.

17. The system of claim 15, wherein:

the conveyor includes a pair of chains moveable in respective parallel loops, the carriage extends between the chains and removably engages the chains, and the path of movement of the foodstuff is disposed between the chains.

18. The system of claim 15, wherein the bag opener includes a plunger through which a vacuum is drawn to grip a surface of the first bag.

19. The system of claim 15, wherein:

the bag opener includes a nozzle and a valve, the nozzle is positioned adjacent the mouth of the first bag, and the valve controls airflow through the nozzle to selectively force open the mouth of the first bag.

20. A system for packing a foodstuff, the system comprising:

a conveyor including a carriage transporting the foodstuff along a path of movement a bag dispenser containing a plurality of bags and moving a first bag of the plurality of bags into the path of movement; and a bag opener moving an upper layer of the first bag relative to a lower layer of the first bag to open a mouth of the first bag, wherein while the mouth of the first bag is open, movement of the carriage and the foodstuff along the path of movement moves the foodstuff and at least a portion of the carriage through the mouth and into the first bag, wherein continued movement of the carriage and the foodstuff while the portion of the carriage and the foodstuff are inside of the first bag removes the first bag from the bag dispenser, and wherein the bag opener includes a paddle that is rotatable about a hinge and includes an actuator that moves the paddle between a retracted position and an extended position.

* * * * *